US006022673A

United States Patent [19]

Ishikawa

[11] Patent Number: 6,022,673

[45] Date of Patent: Feb. 8, 2000

[54] IMAGE FORMING METHOD

[75] Inventor: Shun-ichi Ishikawa, Kanagawa, Japan

[73] Assignee: Fuji Photo Film Co., Ltd., Kanagawa, Japan

[21] Appl. No.: 09/099,674

[22] Filed: Jun. 18, 1998

[30] Foreign Application Priority Data

Sep. 11, 1997 [JP] Japan ..... 9-264992

[51] Int. Cl.[7] ..... G03C 7/407; G03C 7/42

[52] U.S. Cl. ..... 430/351; 430/404

[58] Field of Search ..... 430/351, 404, 430/206, 203

[56] References Cited

U.S. PATENT DOCUMENTS

| | | | |
|---|---|---|---|
| 3,721,562 | 3/1973 | Land | 430/404 |
| 4,550,071 | 10/1985 | Aono et al. | 430/351 |
| 5,773,560 | 6/1998 | Asami | 430/351 |
| 5,843,628 | 12/1998 | Taguchi et al. | 430/351 |
| 5,856,063 | 1/1999 | Hirai et al. | 430/206 |

FOREIGN PATENT DOCUMENTS

| | | | |
|---|---|---|---|
| 62-92943 | 4/1987 | Japan | G03C 7/00 |

*Primary Examiner*—Richard L. Schilling
*Attorney, Agent, or Firm*—Sughrue, Mion, Zinn, Macpeak & Seas, PLLC

[57] ABSTRACT

An image formation method in which a photosensitive element is exposed in image-wise fashion, then, a first treating element comprising a treating layer comprising a base and/or base precursor is prepared, this first treating element is laminated on the photosensitive element so that the treating layer of the first treating element faces the photosensitive layer of the photosensitive element and the resultant laminate is heated for 5 to 60 seconds at a temperature of 60 to 100° C. in the presence of water in an amount of 1 cc/m$^2$ to 50 cc/m$^2$ between the photosensitive layer of the photosensitive element and the treating layer of the first treating element. Then the photosensitive element is separated from the first treating member. Then a second treating element comprising a support carrying thereon a treating layer comprising at least an acidic polymer is prepared. This second treating element is laminated on the photosensitive element so that the treating layer of the second treating element faces the photosensitive layer of the photosensitive element and the resultant laminate is heated for 2 to 60 seconds at a temperature of 40 to 100° C. in the presence of water in an amount of 1 cc/m$^2$ to 50 cc/m$^2$ between the photosensitive layer of the photosensitive element and the treating layer of the second treating element. Then the photosensitive material is separated from the second treating element, to form an image on the photosensitive element.

7 Claims, No Drawings

IMAGE FORMING METHOD

BACKGROUND OF THE INVENTION

1. Field of the Invention

The present invention relates a novel method for obtaining a color image by thermal development using a photosensitive member for photography.

2. Description of the Related Art

In a method known as conventional color photography, the so-called color negative usually contains a layer in which blue light is recorded and a yellow dye image is formed, a layer in which green light is recorded and a magenta dye image is formed, and a layer in which red light is recorded and a cyan dye image is formed, and a developing agent is oxidized in a process wherein silver halide particles containing a latent image are reduced to silver in conducting developing treatment and the oxidized material is reacted with a coupler (coupling) to form a dye image. The undeveloped silver halide and the developed silver are removed in the subsequent bleaching and fixing process, and color paper is exposed to a light passed through the obtained negative dye image and a color print is obtained via the same development, bleaching and fixing processes.

Further, there is also known a method in which after photoelectric reading of image information contained in the above-described color negative, the image information is converted into image information for recording by performing image treatment. Color images are obtained on other print material through this image information. In particular, a digital photo printer has been developed in which the above-described image information is converted to a digital signal, and a photosensitive material such as color paper and the like is scanned and exposed to a recording light modulated by the digital signal to obtain a finished print. An example thereof is described in Japanese Patent Application Laid-Open (JP-A) No. 7-15,593.

The above described methods are based on normal wet developing, bleaching and fixing, and the processes are complicated.

JP-A No. 9-146,247 discloses a method in which a photosensitive element comprising a support carrying thereon a photosensitive layer containing a silver halide particle, coloring developer, coupler and binder and a treating element comprising a support carrying thereon a treating layer containing a base precursor are used and the photosensitive element is exposed in image-wise fashion, then, heat development is conducted in the presence of a small amount of water between the photosensitive element and the treating element to form an image on the photosensitive element, and a color image is obtained on other recording material according to this image information. This image formation method can provide an image having high image quality more simply and quickly than the developing method of conventional photography. However, the image obtained on the photosensitive material is somewhat unstable, and if the image is to be read sometime after development, only degraded image information can be obtained in some cases. Improvement in storage stability of photosensitive elements after development is desired.

SUMMARY OF THE INVENTION

An object of the present invention is to provide a novel image formation method in which an excellent image and an image having excellent storage stability are obtained through a simple treatment.

The above-described object has been accomplished by the following means.

1) An image formation method in which a photosensitive element comprising a support carrying thereon a photosensitive layer comprising at least silver halide particles, coloring developer, coupler and binder is exposed in image-wise fashion. Then, a first treating element comprising a support carrying thereon a treating layer comprising at least a base and/or base precursor is laminated on said photosensitive element so that the treating layer of the first treating element faces the photosensitive layer of the photosensitive element and the resultant laminate is heated for 5 to 60 seconds at a temperature of 60 to 100° C. in the presence of water in an amount of 1 $cc/m^2$ to 50 $cc/m^2$ between the photosensitive layer of the photosensitive element and the treating layer of the first treating element. Then, the photosensitive element is separated from the first treating element, and a second treating element comprising a support carrying thereon a solvent for silver halide and a treating layer comprising at least an acidic polymer is laminated on the photosensitive element so that the treating layer of the second treating element faces the photosensitive layer of the photosensitive element and the resultant laminate is heated for 2 to 60 seconds at a temperature of 40 to 100° C. in the presence of water in an amount of 1 $cc/m^2$ to 50 $cc/m^2$ between the photosensitive layer of the photosensitive element and the treating layer of the second treating element. Next, the photosensitive element is released from the second treating element to form an image on the photosensitive element.

2) The image formation method according to the above-described method 1), wherein the coloring developer is at least one compound selected from compounds represented by the following general formulae (1) to (5):

General formula (1)

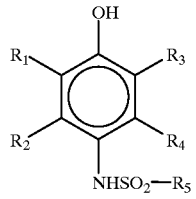

General formula (2)

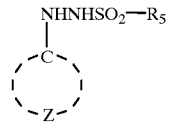

General formula (3)

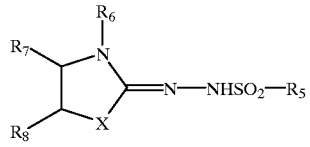

General formula (4)

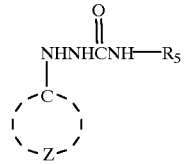

-continued

General formula (5)

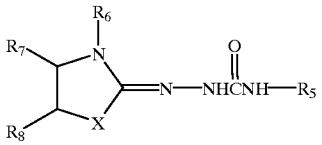

wherein, $R_1$ to $R_4$ represent each independently a hydrogen atom, halogen atom, alkyl group, aryl group, alkylcarbonamide group, arylcarbonamide group, alkylsulfoneamide group, arylsulfoneamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxy carbonyl group, alkylcarbonyl group, arylcarbonyl group or acyloxy group, and $R_5$ represents an alkyl group, aryl group or heterocyclic group. Z represents an atom group forming an aromatic ring (including a heterocyclic aromatic ring) and when Z represents a benzene ring, the total value of Hammett constants ($\sigma$) of the substituents thereof is 1 or more. $R_6$ represents an alkyl group. X represents an oxygen atom, sulfur atom, selenium atom or alkyl-substituted or aryl-substituted tertiary nitrogen atom. $R_7$ and $R_8$ represent a hydrogen atom or substituent, and $R_7$ and $R_8$ may bond each other to form a double bond or ring.

3) The image formation method according to the above-described method 1) or 2), wherein the photosensitive element contains the following compound represented by the following general formula (6):

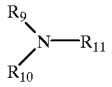

wherein, $R_9$ and $R_{10}$ represent each independently a hydrogen atom, aliphatic group or aryl group, and $R_{11}$, represents an aliphatic group or the general formula (Ab) structure as described below:

General formula (Ab)

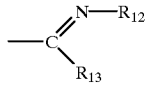

wherein, $R_{12}$ represents a hydrogen atom, aliphatic group or aryl group, and $R_{13}$ represents an aliphatic group, aryl group or amino group. $R_9$ and $R_{10}$, $R_9$ and $R_{11}$, $R_{10}$ and $R_{11}$, and $R_{12}$ and $R_{13}$ may bond each other to form a 5 to 7-membered ring. Three groups $R_9$, $R_{10}$ and $R_{11}$ may bond to each other to form a bicyclo ring. Herein, the total number of the carbon atoms in $R_9$, $R_{10}$ and $R_{11}$, is 10 or more, and at least one of $R_9$ and $R_{10}$ is an aliphatic group. Further, when another one of $R_9$ and $R_{10}$ is an aryl group, $R_{11}$ is a group represented by the general formula (Ab).

The present invention based on the discovery that when a photosensitive element containing a coupler and a coloring developer having extremely high stability in the absence of a base and a treating element containing a base and/or base precursor are used and an image based on a non-diffusive dye is formed on the photosensitive element by heat developing in the presence of a small amount of water, an image excellent in particle form and sharpness is obtained, and when output is effected on other recording material such as color paper, heat developing color print material and the like according to this image information, excellent images are obtained. Further, since the photosensitive element and the base are kept apart until development, quick developing treatment is possible with satisfying high storage stability until development required for a photosensitive element for photography.

In the present invention, the above-described color developing image is formed by heat development by the first treating element (the first treatment), then, further, the second treatment is performed in the presence of a small amount of water using the second treating element having the treating layer containing the acidic polymer, to neutralize the photosensitive layer of the photosensitive element containing a base generated in the first treating process. It has been found that by this simple second treatment, the pH of the photosensitive element drops, and color development due to air oxidation can be suppressed. If an acid having low molecular weight is used in this neutralization reaction, a large amount of salt remains in the photosensitive layer after the second treatment and problems tend to occur in the handling of the photosensitive element after the treatment; for example mutual adhesion of the photosensitive elements. Therefore, a polymeric acid which does not migrate from the second treating element is used.

A solvent for a silver halide is previously contained in the second treating element, and the silver halide is dissolved in the solvent simultaneously with the neutralization. By this procedure, the color developing reaction during storage does not occur, therefore, stability of the image is further enhanced.

The dye obtained from the coloring developer preferably used in the present invention may have two structures, a condition in which a proton is dissociated and a condition in which a proton is not dissociated. Usually, a color developing image is obtained by a dye in a dissociated condition. In this process, when neutralization is effected in the second treatment, the condition may be converted to non-dissociated condition in some cases depending on the pKa of the dye. It has been found that coexistence of an oil of a tertiary amine having high hydrophobicity can effectively prevent this, namely to keep the dye in a dissociated condition even under neutralized conditions.

Regarding the method to output on other material according to the image information after a stabilized image is thus obtained, usual projection exposure may be effected, or image information may be photoelectrically read by measuring the concentration of transmitted light. Output may be effected according to the signal. The material onto output may be a silver halide photosensitive element (color paper) obtained by usual wet treatment, however, a heat developing photosensitive element is particularly preferred. Further, materials other than the photosensitive element, for example, a sublimation type heat-sensitive recording material, inkjet material, electrophotography material, full color direct heat-sensitive recording material and the like may be permitted.

The image on the photosensitive element obtained by the image formation method of the present invention has high storage stability, therefore, the image information can be read again even if the photosensitive element after developing is stored for a long period of time.

DETAILED DESCRIPTION OF THE INVENTION

Respective materials, structure, specific embodiments and the like of the image formation method of the present invention will be described in detail below.

The silver halide which can be used in the present invention may be any of silver iodide bromide, silver bromide, silver chloride bromide, silver iodide chloride, silver chloride and silver iodide chloride bromide. The size of the silver halide particles is preferably from 0.1 to 2 μm, more preferably from 0.2 to 1.5 μm when calculated in terms of the diameter of a sphere having the same volume.

Regarding the shape of the silver halide particle used in the present invention, a particle having a shape composed of normal crystal such as cube, octahedron or tetradecahedron and a particle having plate-like shape of hexagon or rectangle can be used. Among them, a plate-like particle having an aspect ratio of preferably 2 or more, more preferably 8 or more, and most preferably 20 or more is used, and there is used an emulsion in which preferably 50% or more, more preferably 80% or more, and most preferably 90% or more of the projection area of all particles is occupied by such plate-like particles.

Further, particles having high aspect ratio and a thickness of less than 0.07 μm described in U.S. Pat. Nos. 5,494,789, 5,503,970, 5,503,971, 5,536,632 and the like can be preferably used.

Further, plate-like particles having high content of silver chloride having (111) as a main plain described in U.S. Pat. Nos. 4,400,463, 4,713,323, 5,217,858 and the like, and plate-like particles having high content of silver chloride having (100) as a main plain described in U.S. Pat. Nos. 5,264,337, 5,292,632, 5,310,635 and the like can also be preferably used.

In the present invention, it is preferable that the emulsion is usually subjected to chemical sensitization and spectro-sensitization.

As the chemical sensitization, a chalcogen sensitization method using sulfur, selenium or tellurium, a noble metal sensitization method using gold, platinum, iridium and the like, and a so-called reducing sensitization method in which high sensitivity is obtained by introducing a silver nucleus having reducing properties by using a compound having suitable reducing properties in forming a particle, may be used alone or in combination.

Regarding the spectro-sensitization, a so-called spectro-sensitization dye such as a cyanine dye, merocyanine dye, complicated cyanine dye, complicated merocyanine dye, holopolar dye, hemicyanine dyetyryl dye, hemioxonol dye or the like, which adheres to a silver halide particle to give the particle sensitivity in the absorption wavelength range of the dye, may be used alone or in combination, and it is also preferable to use them together with a strong color sensitization agent.

It is preferable to add various stabilizers such as nitrogen-containing heterocyclic compounds such as azaindenes, triazoles, tetrazoles, purines and the like, and mercapto compounds such as mercapto tetrazoles, mercapto triazoles, mercapto imidazoles, mercapto thiadiazoles and the like, to the silver halide emulsion in the present invention for the purpose of preventing fogging and to further enhance storage stability.

In addition, as the additive for photography used for the silver halide emulsion, compounds described in Research Disclosure Nos. 17643 (December, 1978), 18716 (November, 1979), 307105 (November, 1989) and 38957 (September, 1996) can be preferably used.

The photosensitive silver halide is used in an amount of 0.05 to 20 g/m$^2$, preferably 0.1 to 10 g/m$^2$ in terms of silver.

The binder of the photosensitive element is preferably hydrophilic, and examples thereof include those described in the above-described Research Disclosure and JP-A No. 64-13,546, pp. 71 to 75. Among them, gelatin and, combinations of gelatin with other water-soluble binders, for example, polyvinyl alcohol, denatured polyvinyl alcohol, cellulose derivative, acrylamide polymer and the like are preferred. The amount of the binder to be applied for coating is from 1 to 20 g/m$^2$, preferably 2 to 15 g/m$^2$, and more preferably 3 to 12 g/m$^2$. In this, gelatin is used in a proportion of 50 to 100%, preferably 70 to 100%.

As the coloring developer, p-phenylenediamines or p-aminophenols may be used. However, the compounds represented by the above-described general formulae (1) to (5) are preferably used.

The compound represented by the general formula (1) is a compound generically called sulfoneamidephenol.

In the formulae, $R_1$ to $R_4$ represent each independently a hydrogen atom, halogen atom (such as chloro and bromo groups) alkyl group (such as methyl, ethyl, isopropyl, n-butyl and t-butyl groups), aryl group (such as phenyl, tolyl and xylyl groups), alkylcarboneamide group (such as acetylamino, propionylamino, butyloylamino groups), arylcarbonamide group (such as a benzoylamino group), alkylsulfoneamide group (such as methanesulfonylamino and ethanesulfonylamino groups) arylsulfoneamide group (such as benzenesulfonylamino and toluenesulfonylamino groups) alkoxy group (such as methoxy, ethoxy and butoxy groups) aryloxy group (such as a phenoxy group), alkylthio group (such as methylthio, ethylthio and butylthio groups), arylthio group (such as phenylthio and tolylthio groups), alkylcarbamoyl group (such as methylcarbamoyl, dimethylcarbamoyl, ethylcarbamoyl, diethylcarbamoyl, dibutylcarbamoyl, piperidylcarbamoyl and morpholylcarbamoyl groups), arylcarbamoyl group (such as phenylcarbamoyl, methylphenylcarbamoyl, ethylphenylcarbamoyl and benzylphenylcarbamoyl groups), carbamoyl group, alkylsulfamoyl group (such as methylsulfamoyl, dimethylsulfamoyl, ethylsulfamoyl, diethylsulfamoyl, dibutylsulfamoyl, piperidylsulfamoyl and morpholinosulfamoyl groups), arylsulfamoyl group (such as phenylsulfamoyl, methylphenylsulfamoyl, ethylphenylsulfamoyl and benzylphenylsulfamoyl groups), sulfamoyl group, cyano group, alkylsuofonyl group (such as methanesulfonyl and ethanesulfonyl groups), arylsulfonyl group (such as phenylsulfonyl, 4-chlorophenylsulfonyl and p-toluenesulfonyl groups), alkoxycarbonyl group (such as methoxycarbonyl, ethoxycarbonyl and butoxycarbonyl groups), aryloxycarbonyl group (such as a phenoxycarbonyl group), alkylcarbonyl group (such as acetyl, propionyl and buryloyl groups), arylcarbonyl group (such as benzoyl and alkylbenzoyl groups) or acyloxy group (such as acetyloxy, propionyloxy and butyloyloxy groups). Among $R_1$ to $R_4$, $R_2$ and $R_4$ preferably represent a hydrogen atom. And, the total value of Hammett constants (σp) of $R_1$ to $R_4$ is preferably 0 or more.

$R_5$ represents an alkyl group (such as methyl, ethyl, butyl, octyl, lauryl, cetyl and stearyl groups), aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di-(methoxy) carbonyl groups) or heterocyclic group (such as a pyridyl group).

The compound represented by the general formula (2) is a compound generically called sulfonylhydrazine. The compound represented by the general formula (4) is a compound generically called carbamoylhydrazine.

In the formulae, $R_5$ represents an alkyl group (such as methyl, ethyl, butyl, octyl, lauryl, cetyl andstearyl groups), aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di- (methoxy)carbonyl groups) or heterocyclic group (such as a pyridyl group).

Z represents an atom group which forms an aromatic ring. It is necessary that the aromatic ring formed by Z is fully electron attractive for imparting silver developing activity to the compound of the present invention. Therefore, a nitrogen-containing aromatic ring, or an aromatic ring formed by introducing an electron attractive group into a benzene ring is preferably used. As such an aromatic ring, a pyridine ring, pyrazine ring, pyrimidine ring, quinoline ring, quinoxaline ring and the like are preferred.

When the aromatic ring formed by Z is a benzene ring, substituents examples thereof include an alkylsulfonyl group (such as methanesulfonyl and ethanesulfonyl groups), halogen atom (such as chloro and bromo groups), alkylcarbamoyl group (such as methylcarbamoyl, dimethylcarbamoyl, ethylcarbamoyl, diethylcarbamoyl, dibutylcarbamoyl, piperidylcarbamoyl and morpholylcarbamoyl groups), arylcarbamoyl group (such as phenylcarbamoyl, methylphenylcarbamoyl, ethylphenylcarbamoyl and benzylphenylcarbamoyl groups), carbamoyl group, alkylsulfamoyl group (such as methylsulfamoyl, dimethylsulfamoyl, ethylsulfamoyl, diethylsulfamoyl, dibutylsulfamoyl, piperidylsulfamoyl and morpholinosulfamoyl groups), arylsulfamoyl group (such as phenylsulfamoyl, methylphenylsulfamoyl, ethylphenylsulfamoyl and benzylphenylsulfamoyl groups), sulfamoyl group, cyano group, alkylsuofonyl group (such as methanesulfonyl and ethanesulfonyl groups), arylsulfonyl group (such as phenylsulfonyl, 4-chlorophenylsulfonyl and p-toluenesulfonyl groups), alkoxycarbonyl group (such as methoxycarbonyl, ethoxycarbonyl and butoxycarbonyl groups), aryloxycarbonyl group (such as a phenoxycarbonyl group), alkylcarbonyl group (such as acetyl, propionyl and buryloyl groups), arylcarbonyl group (such as benzoyl and alkylbenzoyl groups), and the total value of Hammett constants ($\sigma$) of the above-described substituents is 1 or more.

The compound represented by the general formula (3) is a compound generically called sulfonylhydrazone. The compound represented by the general formula (5) is a compound generically called carbamoylhydrazone.

In the formulae, $R_5$ represents an alkyl group (such as methyl, ethyl, butyl, octyl, lauryl, cetyl andstearyl groups), aryl group (such as phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di-(methoxy)carbonyl groups) or heterocyclic group (such as a pyridyl group).

$R_6$ represents an alkyl group (such as methyl and ethyl groups). X represents an oxygen atom, sulfur atom, selenium atom or alkyl-substituted or aryl-substituted tertiary nitrogen atom, and an alkyl-substituted tertiary nitrogen atom ispreferred. $R_7$and $R_8$represent a hydrogen atom or substituent, and $R_7$ and $R_8$ may bond to each other to form a double bond or ring.

Specific examples of the compounds represented by the general formulae (1) to (5) are shown below. The coloring developer in the present invention is not limited to them, of course.

D-1

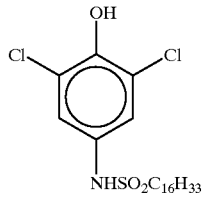

D-2

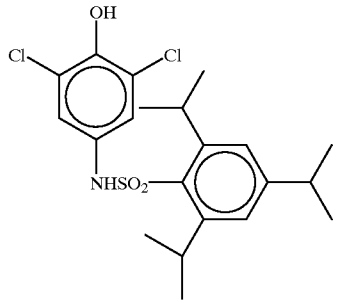

D-3

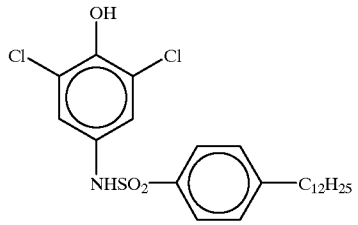

-continued
D-4
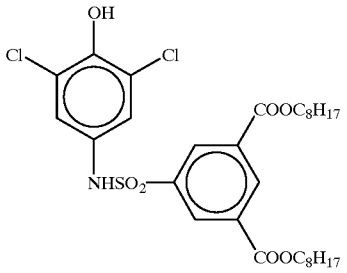
D-5
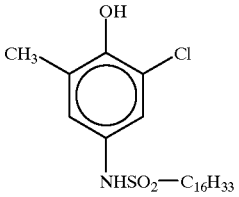
D-6
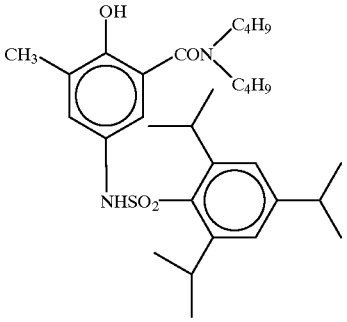
D-7
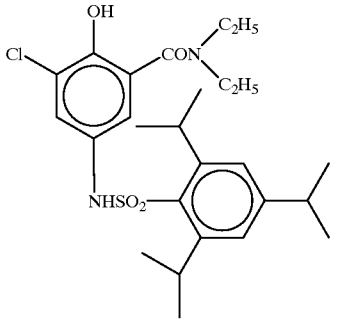
D-8
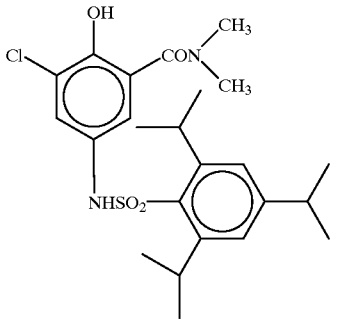

-continued
D-9
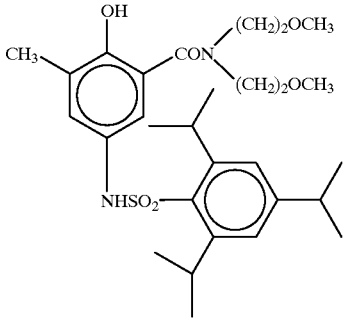
D-10
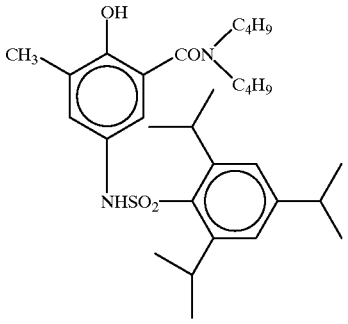
D-11
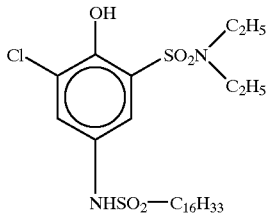
D-12
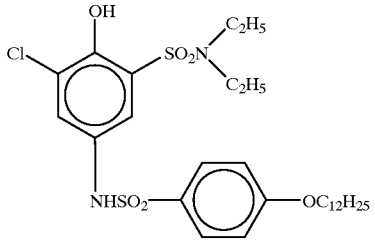
D-13
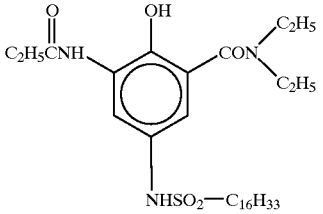

-continued
D-14
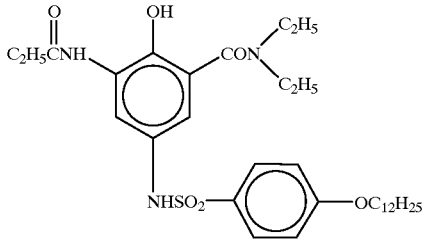
D-15
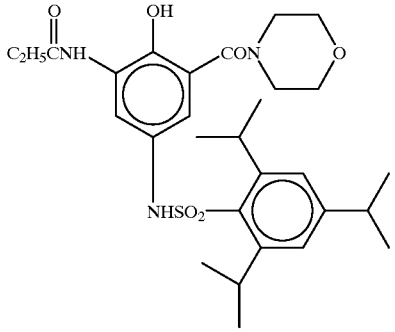
D-16
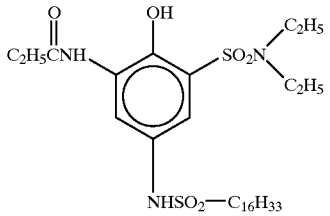
D-17
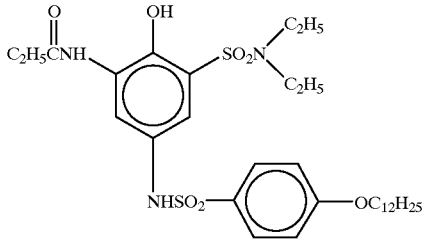
D-18
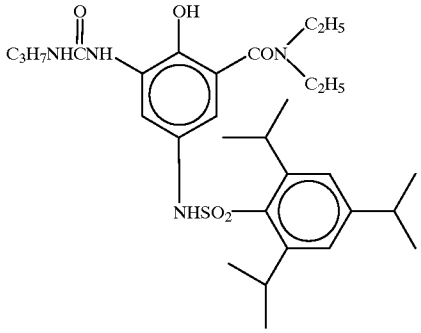

-continued
D-19
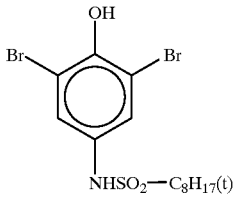
D-20
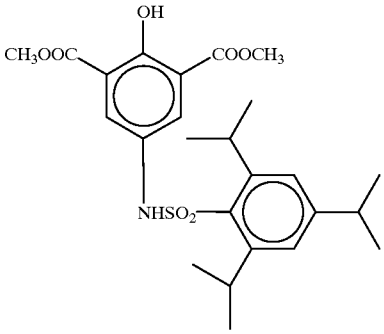
D-21
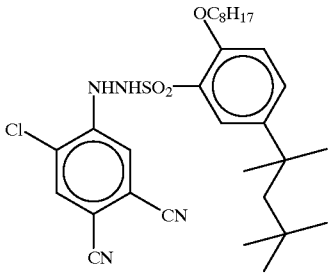
D-22
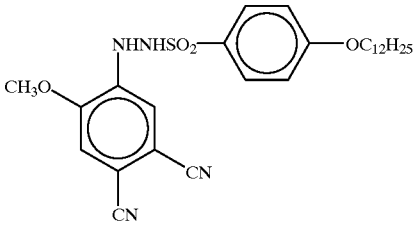
D-23
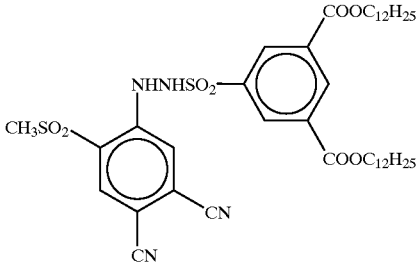

-continued
D-24
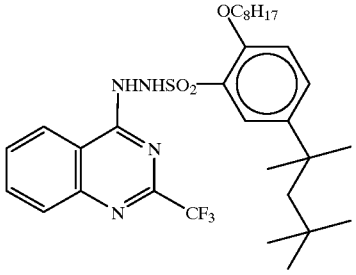
D-25
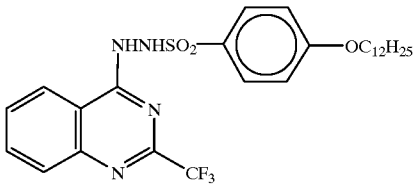
D-26
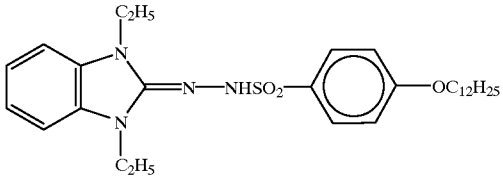
D-27
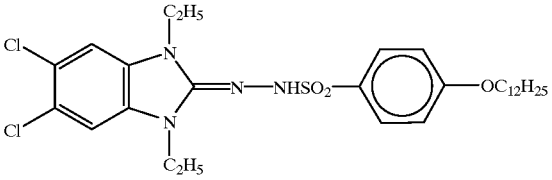
D-28
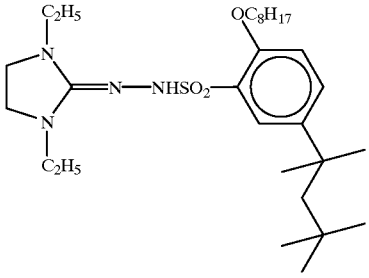
D-29
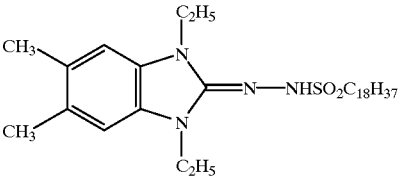
D-30
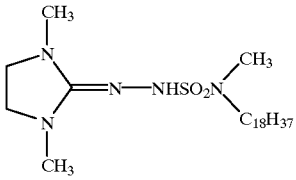

-continued
D-31
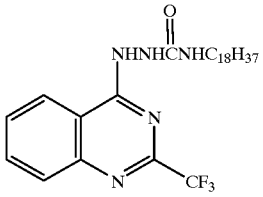
D-32
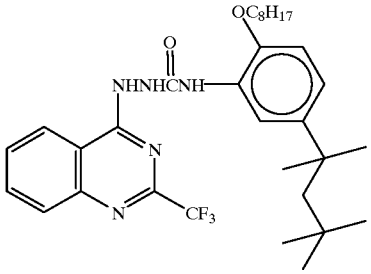
D-33
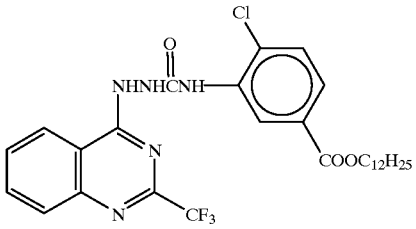
D-34
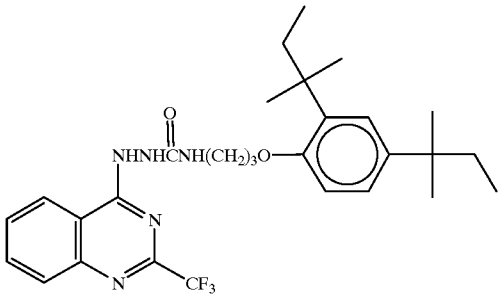
D-35
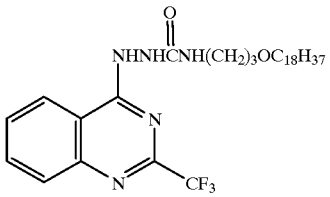
D-36
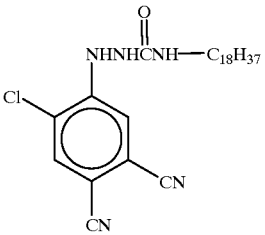

-continued
D-37
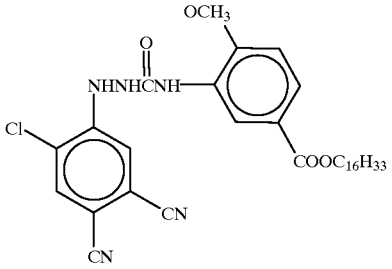
D-38
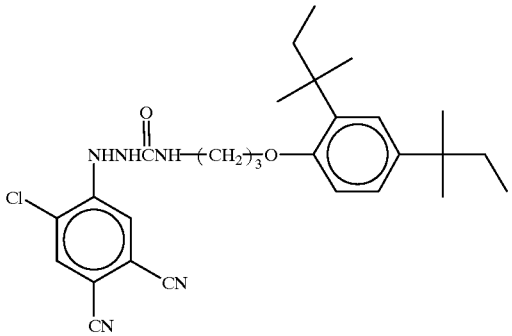
D-39
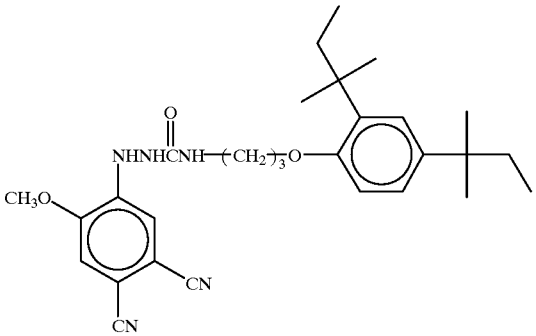
D-40
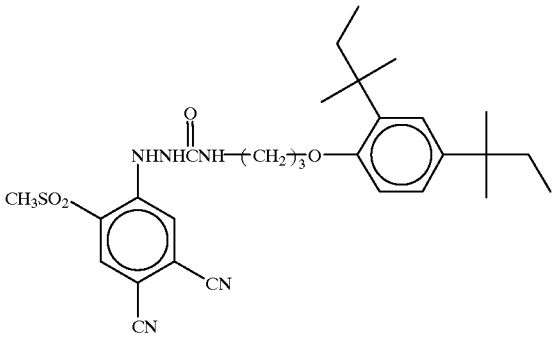

-continued
D-41
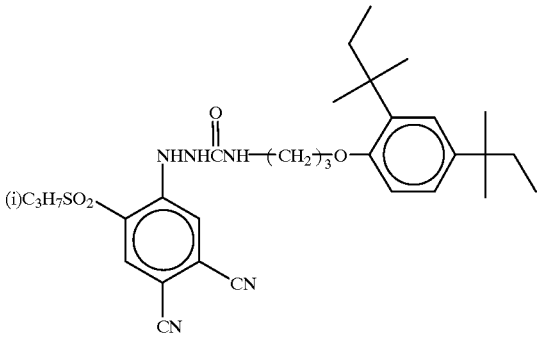
D-42
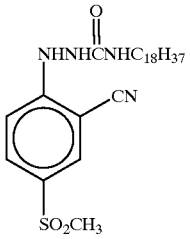
D-43
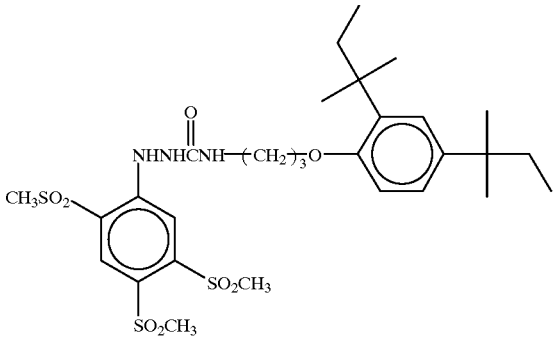
D-44
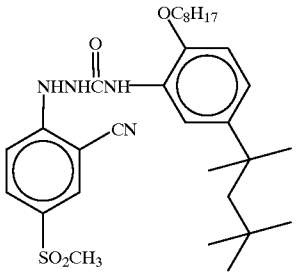
D-45
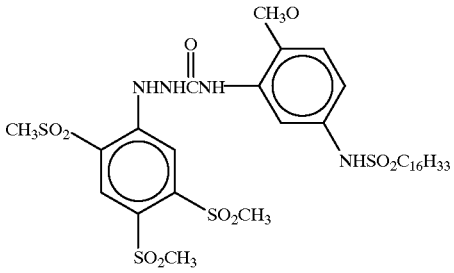

-continued
D-46
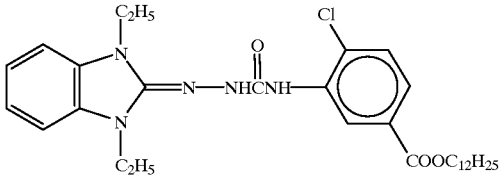
D-47
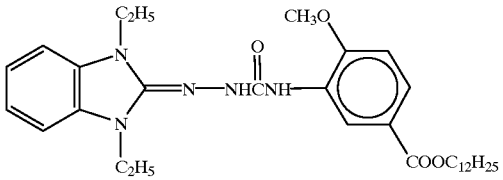
D-48
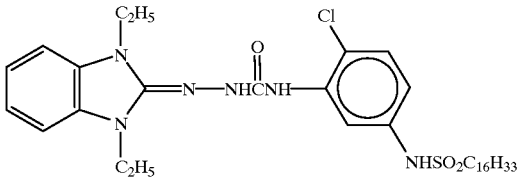
D-49
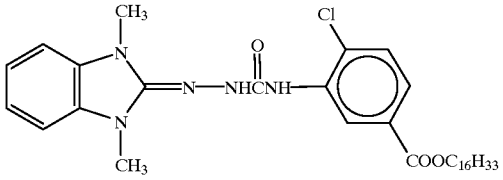
D-50
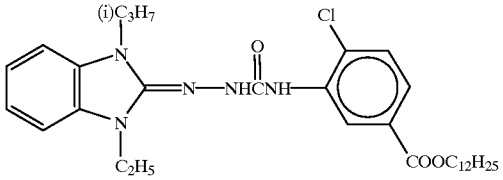
D-51
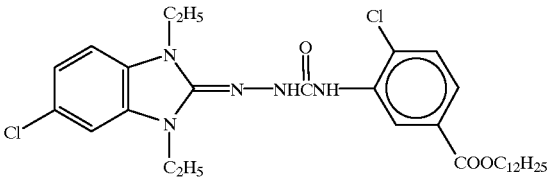
D-52
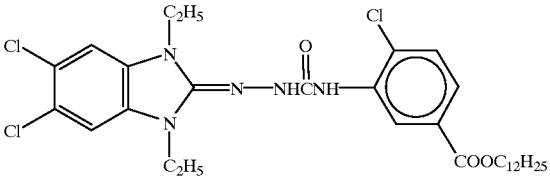

-continued
D-53
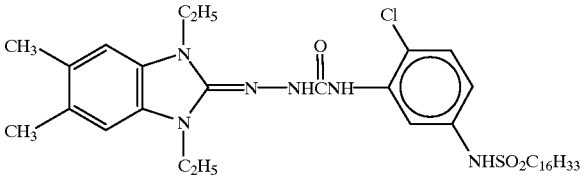
D-54
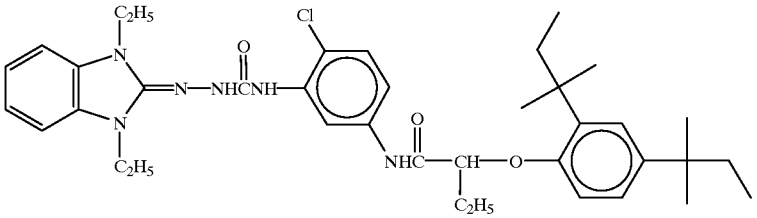
D-55
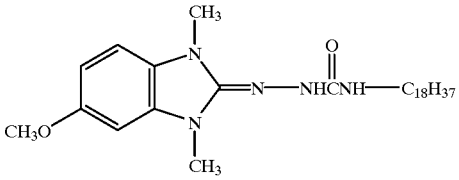
D-56
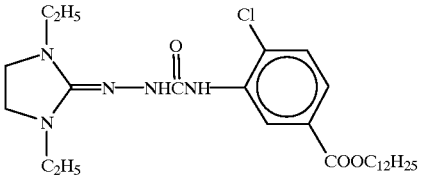
D-57
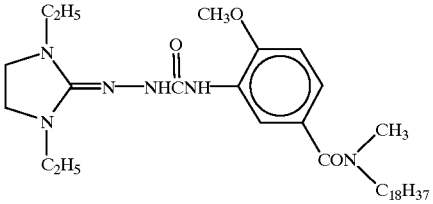
D-58
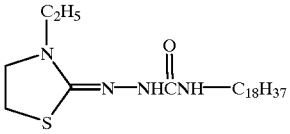
D-59
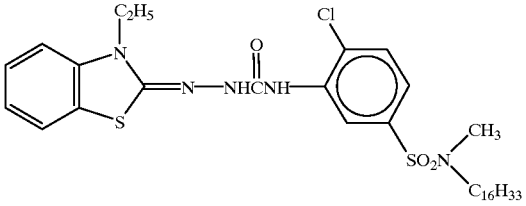

-continued

D-60

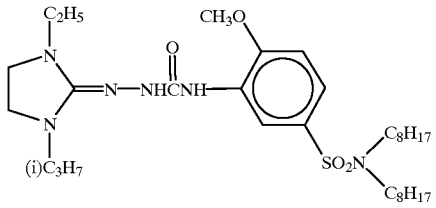

As the coloring developer, the above-described compounds are used alone or in combination of two or more. The different coloring developers may be used in respective layers. The total amount used of these coloring developer is from 0.05 to 20 mmol/$m^2$, preferably from 0.1 to 10 mmol/$m^2$.

In the photosensitive element, a coupler which forms a colorant by a coupling reaction with an oxide of the above-described coloring developer is used. Preferable examples thereof include active methylene, 5-pyrazolone, pyrazoloazole, phenol, naphthol or pyrrolotriazole. Examples thereof which can be preferably used include those described in Research Disclosure No. 38957 (September, 1996), pp. 616 to 624. Preferably examples thereof include pyrazoloazole couplers described in JP-A No. 8-110,608, and pyrrolotriazole couplers described in JP-A No. 8-122,994, Japanese Patent Application No. 8-45,564 and the like.

These couplers are used in an amount from 0.05 to 10 mmol/$m^2$, preferably from 0.1 to 5 mmol/$m^2$ for each color.

In addition, a colored coupler for correcting unnecessary absorption of the color developing dye, a compound (including a coupler) which reacts with an oxide of the coloring developer and releases a compound residue which is photographically useful, for example, a development suppressor, and the like can also be used.

Hydrophobic additives such as the coloring developer, coupler and the like can be introduced in the layer of the photosensitive element by a known method such as a method described in U.S. Pat. No. 2,322,027, and the like. In this case, an organic solvent having high boiling point as described in U.S. Pat. Nos. 4,555,470; 4,536,466; 4,536,467; 4,587,206; 4,555,476; 4,599,296; Japanese Patent Application Publication (JP-B) No. 3-62,256, and the like describe how, according to needs an organic solvent having a low boiling point in the range of 50 to 160° C. can be used with a high boiling point organic solvent. The amount of the organic solvent having high boiling point is 10 g or less, preferably 5 g or less, and more preferably 1 g to 0.1 g based on 1 g of the hydrophobic additive.

In the present invention, it is preferable to use the compound represented by the general formula (6) mixed with the above-described high boiling point organic solvent. It has been found that by mixing, a dye formed exists in a stable dissociated state, and color developing properties are not reduced even if the photosensitive member is neutralized.

The total amount of the compound represented by the general formula (6) and the organic solvent having high boiling point is equivalent to one mol or more per mol of the coupler, and the compound represented by the general formula (6) may be used alone without the organic solvent having high boiling point.

The compound represented by the general formula (6) will be described in detail below.

$R_9$ and $R_{10}$ represent each independently a hydrogen atom, aliphatic group (preferably, an alkyl group or alkenyl group which may have a substituent having 1 to 40 carbon atoms, for example, a methyl group, ethyl group, i-propyl group, t-butyl group, dodecyl group, 4-(2,4-di-t-pentylphenoxy)butyl group, 3-(3-dodecyloxyphenylcarbamoyl)propyl group, 2-hexyldecyl group, cyclohexyl group, 2-phenetyl group, benzyl group, 3-dioctylaminopropyl group, allyl group, 8-octadecenyl group) or aryl group (preferably, a phenyl group which may have a substituent having 6 to 36 carbon atoms, for example, phenyl, 4-dodecyloxyphenyl group, 3-chlorophenyl group). $R_{11}$, represents an aliphatic group (preferably, an alkyl group or alkenyl group which may have a substituent having 1 to 40 carbon atoms, for example, amethyl group, ethyl group, i-propyl group, t-butyl group, dodecyl group, 4-(2,4-di-t-pentylphenoxy)butyl group, 3-(3-dodecyloxyphenylcarbamoyl)propyl group, 2-hexyldecyl group, cyclohexyl group, 2-phenetyl group, benzyl group, 3-dioctylaminopropyl group, allyl group, 8-octadecenyl group) or a group represented by the general formula (Ab).

$R_{12}$ represents a hydrogen atom, aliphatic group (preferably, an alkyl group or alkenyl group which may have a substituent having 1 to 40 carbon atoms, for example, a methyl group, ethyl group, i-propyl group, t-butyl group, dodecyl group, 4-(2,4-di-t-pentylphenoxy)butyl group, 3-(3-dodecyloxyphenylcarbamoyl)propyl group, 2-hexyldecyl group, cyclohexyl group, 2-phenetyl group, benzyl group, 3-dioctylaminopropyl group, allyl group, 8-octadecenyl group) or aryl group (preferably, a phenyl group which may have a substituent having 6 to 36 carbon atoms, for example, phenyl, 4-dodecyloxyphenyl group, 3-chlorophenyl group).

$R_{13}$ represents an aliphatic group (preferably, an alkyl group or alkenyl group which may have a substituent having 1 to 40 carbon atoms, for example, a methyl group, ethyl group, i-propyl group, t-butyl group, dodecyl group, 4-(2,4-di-t-pentylphenoxy)butyl group, 3-(3-dodecyloxyphenylcarbamoyl)propyl group, 2-hexyldecyl group, cyclohexyl group, 2-phenetyl group, benzyl group, 3-dioctylaminopropyl group, allyl group, 8-octadecenyl group), aryl group (preferably, a phenyl group which may have a substituent having 6 to 36 carbon atoms, for example, phenyl, 4-dodecyloxyphenyl group, 3-chlorophenyl group) or amino group (preferably, an amino group which has a substituent having 1 to 50 carbon atoms, and in the case of N,N-disubstitution, two substituents on a nitrogen atom may bond each other to form a heteroring, for example, an anilino group, dioctylamino group, N-ethylanilino group or piperidyl group).

$R_9$ and $R_{10}$, $R_9$ and $R_{11}$, $R_{10}$ and $R_{11}$, and $R_{12}$ and $R_{13}$ may bond with each other to form a 5 to 7-membered ring (for example, a piperazine ring, piperidine ring, pyrrolidine ring, homopiperazine ring). The total number of the carbon atoms in $R_9$, $R_{10}$ and $R_{11}$ is 10 or more, and at least one of $R_9$ and $R_{10}$ is an aliphatic group. Further, when another one of $R_9$ and $R_{10}$ is an aryl group, $R_{11}$ is a group represented by the general formula (Ab).

In the present invention, in view of maintenance of color developing property in neutralizing, it is preferable that $R_9$ and $R_{10}$ represent an aliphatic group. It is preferable that the total number of the carbon atoms in $R_9$, $R_{10}$ and $R_{11}$ is preferably 18 or more, and further preferably from 20 to 80. Further, as the substituent which may be substituted on $R_9$ to $R_{13}$ aliphatic groups, a carbamoyl group, alkoxy group, aryloxy group, aryl group, sulfonyl group, acylamino group, alkylamino group and heterocyclic group are preferable.

Specific examples of the compound represented by the general formula (6) are shown below. The present invention is not limited by them.

(1)

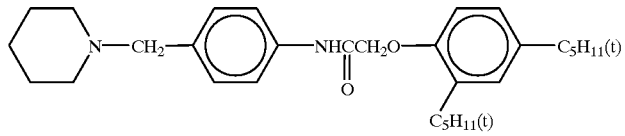

(2)

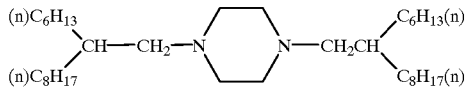

(3)

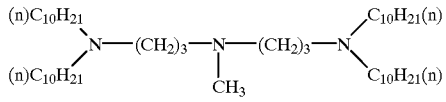

(4)

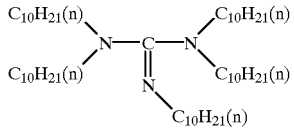

(5)

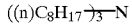

(6)

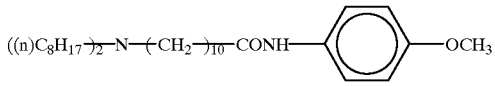

(7)

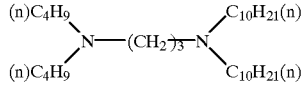

(8)

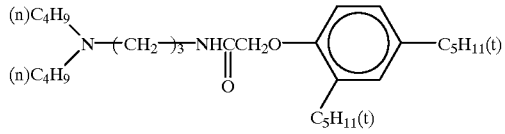

(9)

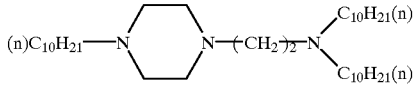

(10)

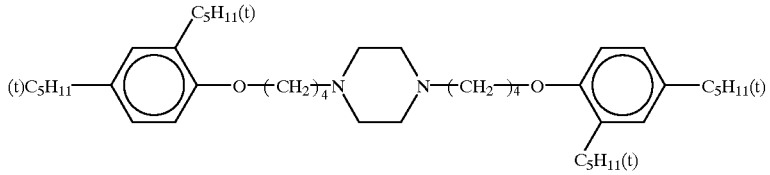

(11)

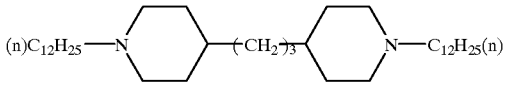

-continued
(12)
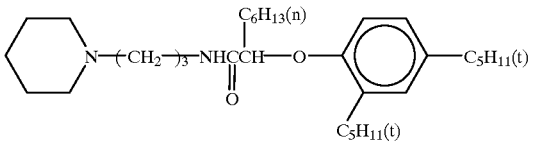
(13)
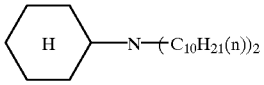
(14)
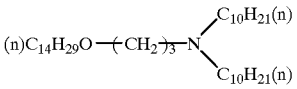
(15)
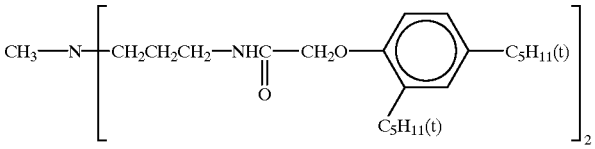
(16)
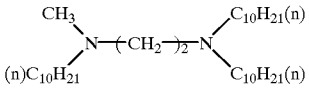
(17)
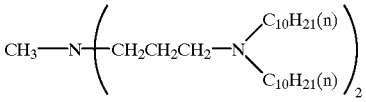
(18)
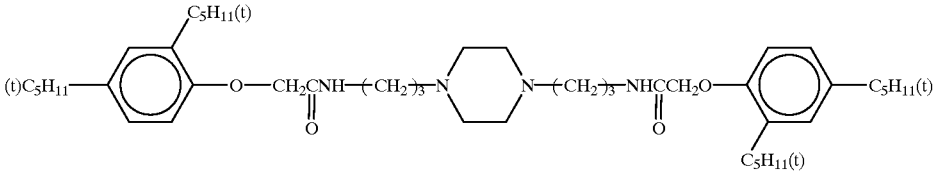
(19)
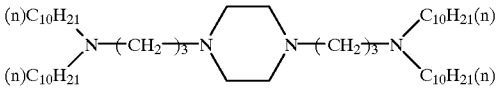
(20)
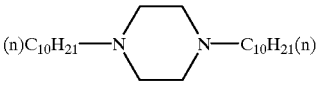
(21)
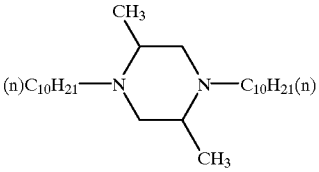
(22)
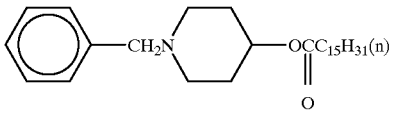
(23)
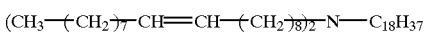

-continued
(24)
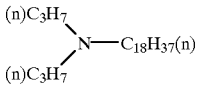
(25)
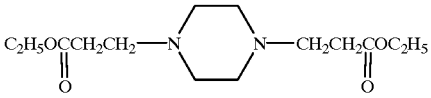
(26)
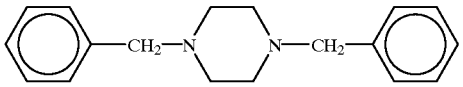
(27)
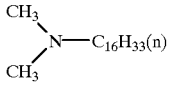
(28)
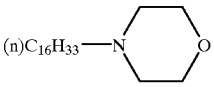
(29)
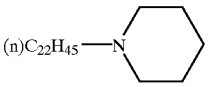
(30)
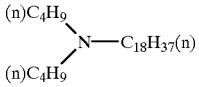
(31)
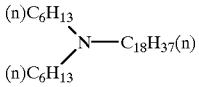
(32)
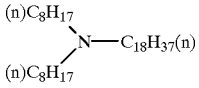
(33)
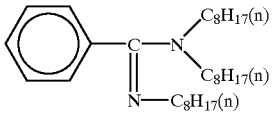
(34)
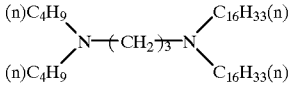
(35)
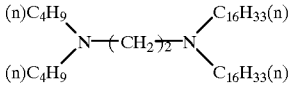
(36)
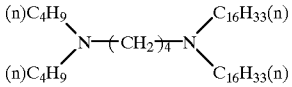

-continued
(37)
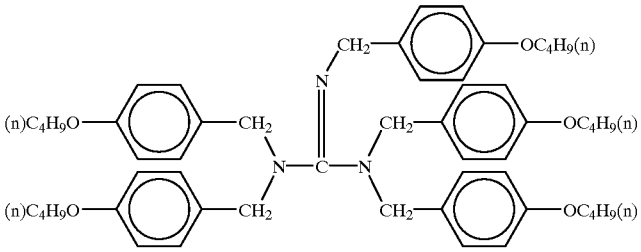
(38)
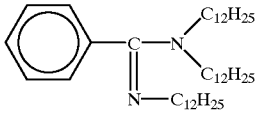
(39)
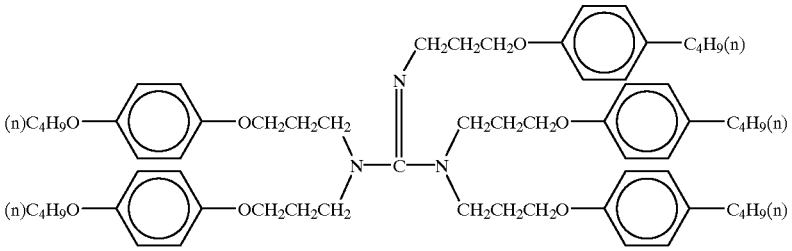
(40)
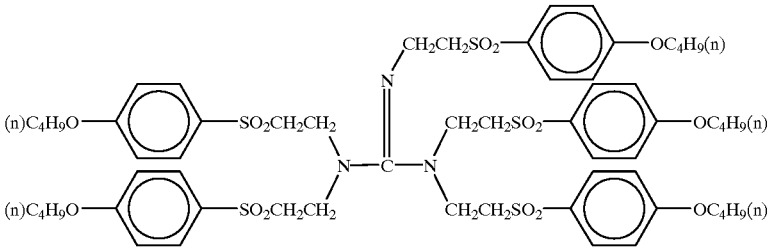
(41)
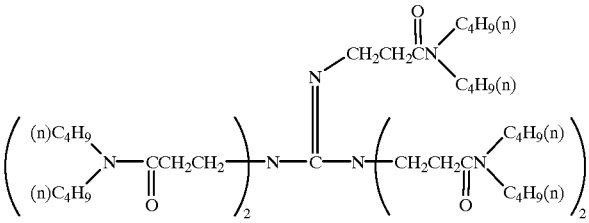
(42)
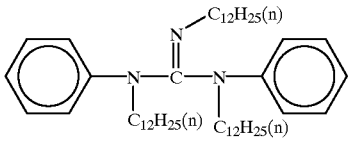
(43)
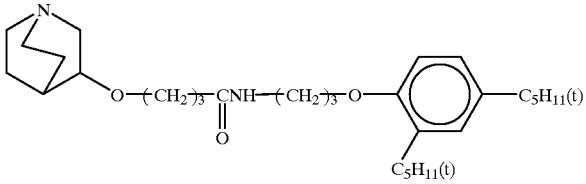

-continued
(44)
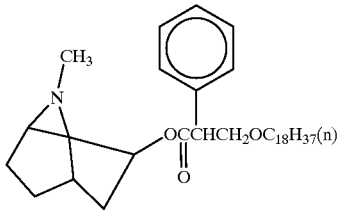
(45)
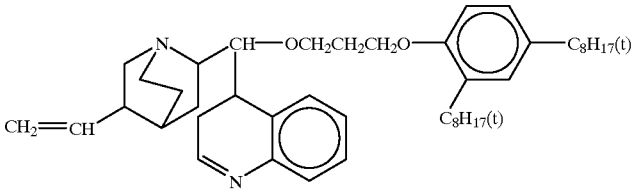
(46)
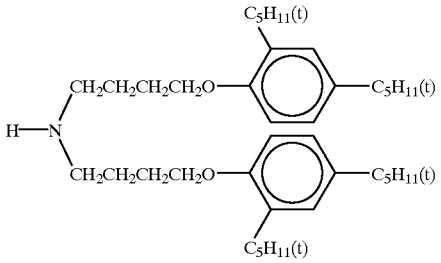
(47)
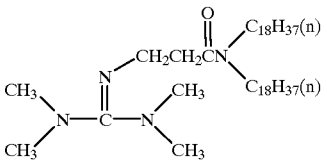
(48)
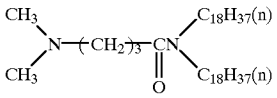
(49)
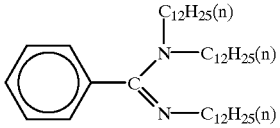
(50)
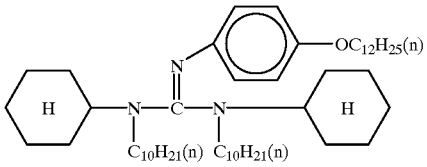
(51)
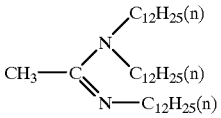

-continued (52)

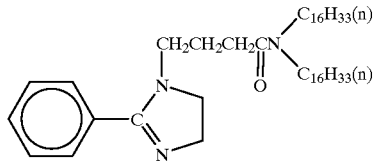

(53)

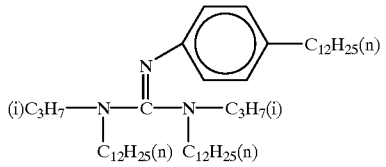

(54)

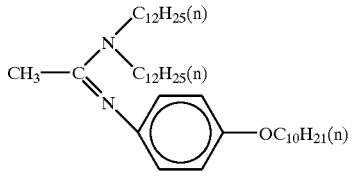

(55)

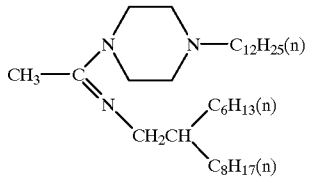

(56)

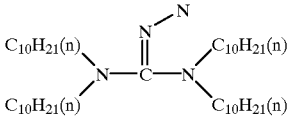

These compounds can be synthesized according to a halogenating alkylation reaction of a primary amine or secondary amine, a reducing reaction of an amide compound, or a method described in Shin Jikken Kagaku Koza vol. 14-3, 1608 (1978). Synthesized examples of the typical compounds are shown below.

(Synthesis of exemplary compound (2))

To 41.0 g of 2-hexyldecanoic acid was added 40 ml of thionyl chloride, and the mixture was heated under reflux for 1 hour. Excess thionyl chloride was distilled off under reduced pressure, then 6.8 g of piperazine, 50 ml of dimethylacetoamide, 100 ml of ethyl acetate and 25 ml of triethylamine were added dropwise with stirring at 15 to 20° C. over 10 minutes. The reaction solution was poured into 200 ml of cool water, and further, extracted with 100 ml of ethyl acetate. The ethyl acetate layer was washed twice with 200 ml of saturated saline, dried over anhydrous magnesium sulfate, and the solvent was distilled off under reduced pressure. The resultant oil was purified by silica gel chromatography, to obtain 41.0 g of an intermediate of the oil. To 20 ml of tetrahydrofuran was added 2.4 g of lithium aluminum hydride, and 11.2 g of the above-described oil was added dropwise to the resultant mixture under stirring at 15 to 20° C. over 5 minutes. The mixture was further stirred with heating for 30 minutes, then, the inner temperature was lowered to 25 to 30° C., and 20 ml of ethyl acetate and 50 ml of water were added dropwise slowly, and the mixture was extracted with 100 ml of ethyl acetate. The ethyl acetate layer was washed with 100 ml of saturated saline, dried over anhydrous magnesium sulfate, and the solvent was distilled off under reduced pressure. The resultant oil was purified by alumina column chromatography to obtain a viscous colorless solution. The resultant compound was identified as the exemplary compound (2) by mass spectrum, NMR spectrum and infrared absorption spectrum (yield weight 8.9 g, yield 83.6% (based on the oil intermediate)).

The photosensitive element is usually composed of three or more photosensitive layers having different color sensitive properties. Each photosensitive layer contains at least one silver halide emulsion layer, and a typical example is composed of a plurality of silver halide emulsion layers having substantially the same color sensitive properties but having different photosensitivities. The photosensitive layer is a unit photosensitive layer having color sensitive property for any of a blue light, green light and red light, and in a multi-layered silver halide color photography photosensitive member, the unit photosensitive layers are generally arranged in the order of a red photosensitive layer, green photosensitive layer and blue photosensitive layer from the support side. However, according to the object, the reverse arrangement order, or an arrangement order in which a different photosensitive layer is sandwiched between photosensitive layers having the same color sensitive property may also be possible.

The total thickness of the photosensitive layers is from 1 to 20 μm, preferably from 3 to 15 μm.

In the present invention, as a coloring layer using an oil-soluble dye which can be bleached in developing treatment, a yellow filter layer, magenta filter layer and anti-halation layer can be used. By this, for example, when photosensitive layers are arranged in the order of a red photosensitive layer, green photosensitive layer and blue photosensitive layer from the side nearest to a support, a yellow filter layer can be provided between the blue photosensitive layer and the green photosensitive layer, a magenta filter layer can be provided between the green photosensitive layer and the red photosensitive layer and a cyan filter layer (anti-halation layer) can be provided between the red photosensitive layer and the support. These coloring layers may directly contact the photosensitive layer (emulsion layer), or may be arranged so as to contact via an intermediate layer such as gelatin and the like. The dyes are used in such amounts that the transmission concentrations of respective layers are from 0.03 to 3.0 mmol/$m^2$, preferably from 0.1 to 1.0 mmol/$m^2$, with respect to blue light, green light and red light respectively. Specifically, it may be from 0.005 mmol/$m^2$ to 2.0 mmol/$m^2$, preferably from 0.05 mmol/$m^2$ to 1.0 mmol/$m^2$, though the amount depends on $\epsilon$ and the molecular weight of the dye.

As the dye used, a cyclic ketomethylene compound described in Japanese Patent Application No. 8-329,124 (for example, 2-pyrazoline-5-one, 1,2,3,6-tetrahydropyridine-2, 6-dione, rhodanine, hydantoin, thiohydantoin, 2,4-ozxazolinedione, isooxazolone, barbituric acid, thiobarbituric acid, indanedione, dioxopyrazolopyridine, hydroxypyridine, pyrazolidinedione, 2,5-dihydrofuran-2-one, pyrroline-2-one), a compound having structure composed of a methyne group and two of acidic nucleus composed of a compound having a methylene group sandwiched between elctron attractive groups (for example, a methylene group sandwiched between —CN, —$SO_2R_{14}$, —$COR_{14}$, —$COOR_{14}$, —$CON(R_{15})_2$, —$SO_2N(R_{15})_2$, —$C[{=}C(CN)_2]R_{14}$, —$C[{=}C(CN)_2]N(R_{14})_2$($R_{14}$ represents an alkyl group, alkenyl group, aryl group, cycloalkyl group, heterocyclic group, $R_{15}$ represents a hydrogen atom or groups as listed for $R_{14}$)), basic nucleus (for example, pyridine, quinoline, indolenine, oxazole, imidazole, thiazole, benzooxazole, benzoimidazole, benzothiazole, oxazoline, naphtooxazole, pyrrole), aryl group (for example, a phenyl group, naphthyl group) and a heterocyclic group (for example, pyrrole, indole, furan, thiophene, imidazole, pyrazole, indolizine, quinoline, carbazole, phenothiadine, phnoxadine, indoline, thiazole, pyridine, pyridazine, thiadiazine, pyran, thiopyran, oxadizole, benzoquinoline, thiadiazole, pyrrolothiazole, pyrrolopyridazine, tetrazole, oxazole, cumarin, cumarone), or $(NC)_2C{=}C(CN)$—$R_{16}$ ($R_{16}$ represents an aryl group or heterocyclic group) is preferable.

Two or more dyes may be mixed and used in one coloring layer in the photosensitive element. For example, three dyes, yellow, magenta and cyan dyes can be mixed and used in the above-described anti-halation layer.

In the present invention, preferably, an oil drop prepared by dissolving a decoloring dye in an oil and/or oil-soluble polymer is used in a dispersed condition in a hydrophilic binder. For preparation thereof, an emulsion dispersion method is preferred, and the preparation can be conducted according to a method described in U.S. Pat. No. 2,322,027. In this case, an oil having a high boiling point as described in U.S. Pat. Nos. 4,555,470; 4,536,466; 4,587,206; 4,555,476; 4,599,296; Japanese Patent Application Publication (JP-B) No. 3-62,256, and the like can be used, optionally together with an organic solvent having a low boiling point from 50 to 160° C. The oil having a high boiling point can be used in combination of two or more. An oil-soluble polymer can be used instead of the oil or together with the oil. Examples thereof are described in WO 88/00723.

The amount of the oil having a high boiling point and/or polymer is 0.1 g to 10 g, preferably 0.1 g to 5 g based on 1 g of the dye used.

For dissolving the dye in the polymer, a latex dispersion method can be used, and specific examples of the process and latex for impregnation are described in U.S. Pat. No. 4,199,363, OLS Nos. 2,541,274; 2,541,230; JP-B No. 53-41,091; EPA 029104 and the like.

For dispersing oil drops in a hydrophilic binder, various surfactants can be used. For example, surfactants described in JP-A No. 59-157,636, pp. 37 to 38, Publicly known techniques, vol. 5 (Mar. 22, 1991, published by Aztech Ltd.), pp. 136 to 138 can be used. Also, phosphate type surfactants described in Japanese Patent Application Nos. 5-204,325; 6-19,247; OLS No. 1,932,299A can be used.

As the hydrophilic binder, a water-soluble polymer is preferred. Examples thereof include natural compounds such as protein such as gelatin or gelatin derivative, or, polysaccharide such as cellulose derivative, starch, gum arabic, dextran, purlane and the like, and synthetic polymer compounds such as polyvinyl alcohol, polyvinylpyrrolidone, acrylamide polymer and the like. These water-soluble polymers can also be used in combination of two or more. Especially, combination with gelatin is preferred. Gelatin may advantageously be selected from lime-processed gelatin, acid-processed gelatin, and so-called delimed gelatin in which the content of calcium and the like is reduced, according to various objects, and can also be used in combination.

The dye is decolored when treated in the presence of a decoloring agent.

Examples of the decoloring agents include alcohol or phenols, amines or anilines, sulfinic acids or salts thereof, sulfurous acid or salts thereof, thiosulfuric acid or salts thereof, carboxylic acids or salts thereof, hydrazines, guanidines, aminoguanidines, amidines, thiols, cyclic or linear active methylene compounds, cyclic or linear active methyne compounds, and anion species generated from these compounds.

Among them, preferably used are hydroxyamines, sulfines, sulfurous acid, guanidines, aminoguanidines, heterocyclic thiols, cyclic or linear active methylene compounds, cyclic or linear active methyne compounds, and particularly preferably used are guanidines and aminoguanidines.

It is supposed that the above-described decoloring agent decolors the dye by contacting the dye in development treating, and effecting nucleophilic addition to the dye molecule. Preferably, a silver halide photosensitive element containing a dye is laminated with a treating element (the first treating element as described later) containing a decoloring agent or decoloring agent precursor in the presence of water so that the membrane surfaces face each other and heated, after image-wise exposure or simultaneously with image-wise exposure, and separating the elements, to obtain a color developing image on the silver halide photosensitive element and to decolor the dye. In this case, the concentration of the dye after decoloring is ⅓ or less, preferably ⅕ or less of the original concentration. The amount used of the decoloring agent is from 0.1 to 200-fold by mol, preferably from 0.5 to 100-fold by mol of the dye.

The silver halide, coloring developer and coupler may be contained in the same photosensitive layer or in different layers. Also, in addition to the photosensitive layer, a protective layer, primer layer, intermediate layer and non-photosensitive layers such as the above-described yellow filter layer, anti-halation layer and the like may be provided, and the support may have a back layer on the rear side. The total thickness of the all applied films on the photosensitive layer side of the support is from 3 to 25 μm, preferably from 5 to 20 μm.

In the photosensitive element, a film curing agent, surfactant, photography stabilizer, antistatic agent, lubricant, matting agent, latex, formalin scavenger, dye, UV absorber, and the like can be used for various objects. Specific examples thereof are descried in the above-described Research Disclosure and Japanese Patent Application No. 8-30,103. Examples of particularly preferable antistatic agent include metal oxide fine particles such as ZnO, $TiO_2$, $Al_2O_3$, $In_2O_3$, $SiO_2$, MgO, BaO, $MoO_3$, $V_2O_5$ and the like.

As the support of the photosensitive element, a support for photography described in Nippon Shashin Gakkai edit. "Shashinkogaku no kiso (The Basics of Photographic Technology)-silver salt photography volume" Corona Corp. (1979), pp. 223 to 240 is preferred. Specific examples thereof include polyethylene terephthalate, polyethylene naphthalate, polycarbonate, syndiotactic polystyrene, cellulose (for example, triacetyl cellulose) and the like.

Among them, a polyester containing as a main component polyethylene naphthalate is preferred. The polyester "containing as a main component polyethylene naphthalate" indicates a polyester in which the proportion of naphthalenedicarboxylic acid contained in the whole of the dicarboxylic acid residues is 50 mol % or more, preferably 60 mol % or more, and more preferably 70 mol %. This may be a copolymer or a polymer blend.

In the case of the copolymer, copolymers obtained by copolymerizing a unit such as terephthalic acid, bisphenol A, cyclohexanedimethanol and the like, in addition to the naphthalenedicarboxylic acid unit and ethylene glycol unit, are also preferable. Among them, that which is obtained by copolymerizing the terephthalic acid unit is most preferable in view of mechanical strength and cost.

Examples of a partner of the polymer blend include polyesters such as polyethylene terephthalate (PET), polyallylate (PAr), polycarbonate (PC), polycyclohexanedimethanol terephthalate (PCT) and the like, in view of compatibility, and among them, a polymer blend with PET is preferred in view of mechanical strength and cost.

Specific examples of the preferred polyester are shown below.

Polyester copolymer example (number in bracket indicates ratio by mol)

2,6-naphthalenedicarboxylic acid/terephthalic acid/ethylene glycol (70/30/100) Tg=98° C.

2,6-naphthalenedicarboxylic acid/terephthalic acid/ethylene glycol (80/20/100) Tg=105° C. Polyester polymer blend example (number in bracket indicates ratio by weight)

PEN/PET (60/40) Tg=95° C.

PEN/PET (80/20) Tg=104° C.

These supports can be subjected to heat treatment (control of crystallinity and orientation), monoaxial and biaxial stretching and flexing (control of orientation), blending together of various polymers, surface treatment and the like, to improve optical properties and physical properties.

It is preferable that as the support, a support having a magnetic recording layer described in JP-A Nos. 4-124,645, 5-40,321, 6-35,092 and 6-31,875 is used, and photography information and the like are recorded.

It is also preferable to apply a water-proof polymer as described in JP-A No. 8-292,514 on the rear surface of the support of the photosensitive member.

The polyester support preferably used in the photosensitive member having the magnetic recording layer as described above is described in Journal of Technical Disclosure 94-6023 (JAPIO; Mar. 15, 1994) in detail.

The thickness of the support is from 5 to 200 μm, preferably from 40 to 120 μm.

In the present invention, the first treating element comprising a support carrying thereon a treating layer comprising at least a base and/or base precursor is used for developing a photosensitive element after photographing. As the base, an inorganic or organic base can be used. Examples of the inorganic base include the hydroxide, phosphate, carbonate, borate, organic acid salt of alkaline metals or alkaline earth metals described in JP-A No. 62-209,448, the acetylide of alkaline metals or alkaline earth metals described in JP-A No. 63-25,208, and the like.

Examples of the organic base include ammonia, aliphatic or aromatic amines (for example, primary amines, secondary amines, tertiary amines, polyamines, hydroxylamines, heterocyclic amines), amidines, bis or tris or teteramidine, guanidines, water-insoluble mono, bi, tri or tetraguanidines, hydroxides of quaternary ammonium, and the like.

As the base precursor, decarboxylation type, decomposing type, reacting type and complex salt forming type precursors can be used.

Examples of the bases and base precursors preferably used in the present invention are described in Publicly-known techniques No. 5 (published on Mar. 22, 1991, Azutech Ltd.), pp. 55 to 88.

The base generating method most preferably used in the present invention is a method described in EP 210,660 and U.S. Pat. No. 4,740,445, in which a base is generated by combining a basic metal compound poorly soluble in water with a compound which can conduct a complex forming reaction using as media water and a metal ion constituting this basic metal compound. In this case, it is preferable that the basic compound poorly soluble in water is added to the photosensitive element, and the complex forming compound is added to the first treating element, however, the reverse mode is possible. The preferable combination of compounds is a system in which fine particles of zinc hydroxide are used in the photosensitive element, and a salt of picolinic acid, such as guanidine picolinate is used in the first treating element.

A mordant may be used in the first treating element, and in this case, a polymer mordant is preferred. Further, in addition, water-soluble polymers such as gelatin as described in the column of photosensitive element as the binder are preferably used.

The first treating element may contain a protective layer, primer layer, back layer and other auxiliary layers in addition to the treating layer. These layers are the same as those in the photosensitive element, and are required to be cured by a film curing agent. The film curing agent used is the same as that of the photosensitive element.

In a preferable embodiment of the first treating element, the treating layer is formed on a continuous web, and the element is wound on another roll without being cut even after being fed from a feeding roll and used for treatment. An example thereof is described in JP-A No. 9-127,670.

The support of the first treating element is not restricted, and the plastic film as described in the column of the photosensitive element, or paper can be used. The thickness is from 4 to 120 μm, preferably from 6 to 70 μm.

A film on which aluminum is deposited as described in Japanese Patent Application No. 8-52,586 can also be preferably used.

The second treating element has a treating layer containing at least an acidic polymer. The preferable acidic polymer in the present invention is one containing a —COOH group or —$SO_3H$ group in part of a repeating unit of the structure. Examples of the acidic polymer include polymers of acrylic acid, methacrylic acid or maleic acid and partial esters thereof or acid anhydrides as described in U.S. Pat. No. 3,362,819, copolymers of acrylic acid with acrylates as described in FRP No. 2, 290,699, latex type acidic polymers as described in U.S. Pat. No. 4,139,383 and Research Disclosure No. 16102 (1977) and the like.

If an acid having a low molecular weight is used in this neutralization reaction, a large amount of salts remain in the photosensitive layer after the second treatment and problems tend to occur regarding handling of the photosensitive element after the treatment such as mutual adhesion of the photosensitive elements, therefore, a polymeric acid which does not migrate from the second treating element is used.

These acidic polymers may be partially neutralized. The amount of the acidic polymer, taken as the amount of acid is preferably from 0.9 to 2.0 times in terms of the amount of the generated base. Practically, it is preferable to control the pH of the film surface of the photosensitive element after the second treatment to be from 5 to 8, preferably from 6 to 7.

It is preferable that the treating layer of the second treating element contains other water-soluble polymers to act as the binder in addition to the acidic polymer. Examples thereof are the same as those of the photosensitive element and the first treating element.

It is preferable that a solvent for a silver halide is further contained in the second treating element. As the silver halide, known compounds can be used. For example, thiosulfates, sulfites, thiocyanates, thioether compounds described in JP-B No. 47-11,386, compounds having a 5 or 6-membered imide group such as uracil and hydantoin described in JP-A No. 8-179,458, compounds having a carbon-sulfur double bond described in JP-A No. 53-144, 319, and mesoion thiolate compounds such as trimethyltriazolium thiolate and the like described in Analytica Chimica Acta, vol. 248, pp. 604 to 614, (1991) are preferably used. Further, a compound which can fix and stabilize a silver halide described in JP-A No. 8-69,097 can also be used as the solvent for a silver halide. The most preferable is the above-described mesoion thiolate compound.

The solvent for a silver halide may be used alone, or in combination of two or more.

The total amount of the solvents for a silver halide in the treating layer of the second treating element is from 0.01 to 100 mmol/$m^2$, preferably from 0.1 to 50 mmol/$m^2$. The amount is from 1/20 to 20-fold, preferably from 1/10 to 10-fold, more preferably from 1/4 to 4-fold in terms of mol ratio, based on the amount of silver applied on the photosensitive element.

The solvent for a silver halide may be added as a solvent or acidic aqueous solution such as water, methanol, ethanol, acetone, dimethylformamide, methypropylene glycol and the like, or may be dispersed with a solid fine particle and added to a applying solution.

The second treating element may contain a protective layer, primer layer, back layer and other auxiliary layers in addition to the treating layer. These layer are the same as those in the photosensitive element, and are required to be cured by a film curing agent. The film curing agent used is also the same as that of the photosensitive element.

The support which is preferably used in the second treating element is the same as that of the first treating element.

In a preferable embodiment of the second treating element, the treating layer is formed on a continuous web, and the element is wound on another roll without being cut even after being fed from a feeding roll and used for treatment, in the same manner as in the first treating element.

In practical image formation of the present invention, for example, the photosensitive element is processed so that it can be used in a regular 135 camera, APS camera, or film equipped with a lens, and filled in a cartridge. The photosensitive element photographed by the camera is drawn out from the cartridge, and first, heat development is conducted in the presence of water between the photosensitive layer and the treating layer using the first treating element. If the amount of water is too small, the development does not fully progress. On the other hand, if too large, problems occur such as overflow of water from the film surface, long drying time after separating, and the like. The amount of water is preferably from 1/10th to the full amount required for maximum swelling of the whole applied film except both back layers of the photosensitive element and the first treating element. Specifically, from 1 cc/$m^2$ to 50 cc/$m^2$. In the presence of this water, the photosensitive element is laminated with the treating element so that the photosensitive layer of the photosensitive element faces the treating layer of the treating element, and the laminate is heated at a temperature from 60 to 100° C. for 5 to 60 seconds.

As the water supplying method, there is a method in which the photosensitive element or treating member is immersed in water, and excess water is removed by a squeeze roller. Further, a method described in Japanese Patent Application No. 8-196,945, in which water is sprayed by a water applying apparatus comprising a nozzle having a plurality of nozzle pores from which water is sprayed are arranged at constant intervals in linearly along the direction crossing the transferring direction of the photosensitive element or treating element, and an actuator which displaces the nozzles toward the photosensitive element or treating element on the transferring route, is also preferable. Further, a method in which water is applied by a sponge and the like is also preferred.

As the heating method, contact with a heated block or plate may be adopted, or a heat roller, heat drum, infrared and far infrared lamp, and the like may be used.

After the first treatment, the photosensitive element is released from the first treating element, then, the second treatment is conducted in the same manner using the second treating element. The amount of water is from 1 cc/$m^2$ to 50 cc/$m^2$, and the heating is conducted for 2 to 60 seconds at 40 to 100° C.

After the second treatment, a stabilized image is formed on the photosensitive element by separating the photosensitive element from the second treating element and drying the element. It is also possible to wash the photosensitive element before drying.

As a preferable embodiment of the present invention, an image is obtained on the photosensitive element, then, a color image is formed on another recording material according to the information. As this method, a photosensitive element such as color paper may be used and usual projection exposure may be conducted. However, in a preferable embodiment, image information is photoelectrically read by measuring the concentration of transmitted light. The information is converted into a digital signal, and image treatment is conducted. Then, output is effected on another recording material such as a heat developing photosensitive element and the like according the signal. The material onto which output if effected may be a sublimation type heat-sensitive recording material, full color direct heat-sensitive recording material, inkjet material, electrophotography material, and the like, in addition to the photosensitive element using a silver halide.

The photosensitive element after use can also be filled in the original or another cartridge and stored.

EXAMPLES

The following examples further illustrate the present invention, but, do not limit the scope thereof.

Example 1

Production of photosensitive element 101

<Preparation method of photosensitive silver halide emulsion>

A method for preparing a blue photosensitive silver halide emulsion (1) is described below.

1191 ml of distilled water containing 0.96 g of gelatin having an average molecular weight of 12000 and 0.9 g of potassium bromide was charged in a reaction vessel, and heated up to 40° C. To this solution were added 10.5 ml of an aqueous solution (A) containing 0.5 g of silver sodium nitrate and 10 ml of an aqueous solution (B) containing 0.35 g of potassium bromide with vigorous stirring over 150 seconds. Thirty seconds after the completion of the addition, 12 ml of a 10% potassium bromide aqueous solution was added, and after 30 seconds, the temperature of the reaction solution was raised to 75° C. To this was added 35.0 g of lime-processed gelatin together with 250 ml of distilled water, then, 39 ml of an aqueous solution (C) containing 10.0 g of silver nitrate and 30 ml of an aqueous solution (D) containing 6.7 g of potassium bromide were added over 3 minutes and 15 seconds while increasing addition flow rate.

Then, 302 ml of an aqueous solution (E) containing 96.7 g of silver nitrate and an aqueous solution (F) containing potassium iodide in a mol ratio to potassium bromide of 7:93 (concentration of potassium bromide: 26%) were added over 20 minutes while increasing addition flow rate and controlling the silver potential of the reaction solution to −20 mV based on the saturated calomel electrode. Further, 97 ml of an aqueous solution (G) containing 24.1 g of silver nitrate and a 21.9% aqueous solution (H) of potassium bromide were added over 3 minutes while controlling the silver potential of the reaction solution to 25 mV based on the saturated calomel electrode. After completion of the addition, the temperature of the reaction solution was kept at 75° C. for 1 minute, then, lowered to 55° C. Then, 15 ml of 1 N sodium hydroxide was added. Two minutes layer, 100 ml of an aqueous solution (I) containing 5 g of silver nitrate and 200.5 ml of an aqueous solution (J) containing 4.7 g of potassium iodide were added over 5 minutes. After completion of the addition, 7.11 g of potassium bromide was added, and the solution was kept at 55° C. for 1 minute. Then, 248 ml of an aqueous solution (K) containing 62 g of silver nitrate and 231 ml of an aqueous solution (L) containing 48.1 g of potassium bromide were added over 8 minutes. Thirty seconds later, an aqueous solution containing 0.03 g of sodium ethylthiosulfonate was added. The temperature of the solution was lowered, and the emulsion particles were flocculated and precipitated using an anionic surfactant (Demol: manufactured by Kao Corp.) for conducting desalting. Dispersion was conducted by adding sodium benzenesulfonate, phenoxyethanol, water-soluble polymer (10) and lime-processed gelatin.

Chemical sensitization was conducted at 60° C. A gelatin dispersed material of a sensitizing dye (12) was added before the chemical sensitization, then, a mixed solution of potassium thiocyanate and chloro aurate was added, then, sodium thiosulfate and a selenium sensitizing agent were added, and termination of the chemical sensitization was conducted using a mercapto compound. The amounts of the sensitizing dye (12), chemical sensitizing agent and mercapto compound were optimized by sensitivity and fogging.

Regarding particles of the resultant emulsion, the proportion of plate-like particles occupied over 99% of the total projected area of all particles. The average diameter in terms of a sphere was 1.07 μm. The average thickness was 0.38 μm, average equivalent circle diameter was 1.47 μm, and the average aspect ratio was 3.9.

Sensitizing dye (12)

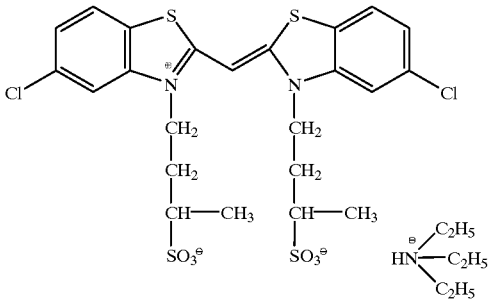

Water-soluble polymer (10)

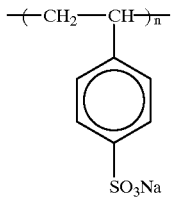

Selenium sensitizing agent

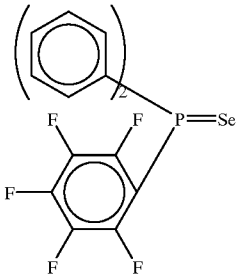

Mercapto compound

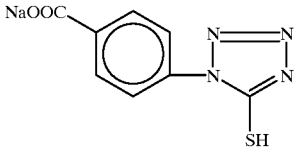

A method for preparing a blue photosensitive silver halide emulsion (2) is described below.

1191 ml of distilled water containing 0.96 g of gelatin having an average molecular weight of 12000 and 0.9 g of potassium bromide was charged in a reaction vessel, and heated up to 40° C. To this solution were added 37.5 ml of an aqueous solution (A) containing 1.5 g of silver nitrate and 37.5 ml of an aqueous solution (B) containing 1.051 g of potassium bromide with vigorous stirring over 90 seconds. Thirty seconds after the completion of the addition, 12 ml of a 10% potassium bromide aqueous solution was added, and after 30 seconds, the temperature of the reaction solution was raised to 75° C. To this was added 35.0 g of lime-processed gelatin together with 250 ml of distilled water, then, 116 ml of an aqueous solution (C) containing 29.0 g of silver nitrate and 91 ml of an aqueous solution (D) containing 20 g of potassium bromide were added over 11 minutes and 35 seconds while increasing addition flow rate.

Then, 302 ml of an aqueous solution (E) containing 96.7 g of silver nitrate and an aqueous solution (F) containing potassium iodide in a mol ratio to potassium bromide of 3.3:96.7 (concentration of potassium bromide: 26%) were added over 20 minutes while increasing addition flow rate and controlling the silver potential of the reaction solution to 2 mV based on the saturated calomel electrode. Further, 97 ml of an aqueous solution (G) containing 24.1 g of silver nitrate and a 21.9% aqueous solution (H) of potassium bromide were added over 3 minutes while controlling the silver potential of the reaction solution to 0 mV based on the saturated calomel electrode. After completion of the addition, the temperature of the reaction solution was kept at 75° C. for 1 minute, then, lowered to 55° C.

Then, 15 ml of 1 N sodium hydroxide was added. Two minutes later, 153 ml of an aqueous solution (I) containing 10.4 g of silver nitrate and 414.5 ml of an aqueous solution (J) containing 9.35 g of potassium iodide were added over 5 minutes. After completion of the addition, 7.11 g of potassium bromide was added, and the solution was kept at 55° C. for 1 minute. Then, 228 ml of an aqueous solution (K) containing 57.1 g of silver nitrate and 201 ml of an aqueous solution (L) containing 43.9 g of potassium bromide were added over 8 minutes. Thirty seconds later, an aqueous solution containing 0.04 g of sodium ethylthiosulfonate was added. The temperature of the solution was lowered, and desalting and dispersion were conducted in the same manner as in the blue photosensitive silver halide emulsion (1). Chemical sensitization was conducted in the same manner as in the blue photosensitive silver halide emulsion (1) except that the selenium sensitizing agent was not added. The amounts of the sensitizing dye and the mercapto compound for termination of the chemical sensitization were approximately in proportion to the surface area of the emulsion particle.

Regarding particles of the resultant emulsion, the proportion of plate-like particles occupied over 99% of the total projected area of all particles. The average diameter in terms of a sphere was 0.66 μm. The average thickness was 0.17 μm, average equivalent circle diameter was 1.05 μm, and the average aspect ratio was 6.3.

A method for preparing a blue photosensitive silver halide emulsion (3) is described below.

1345 ml of distilled water containing 17.8 g of lime-processed gelatin, 6.2 g of potassium bromide and 0.4 g of potassium iodide was charged in a reaction vessel, and heated up to 45° C. To this solution were added 70 ml of an aqueous solution (A) containing 11.8 g of silver nitrate and 70 ml of an aqueous solution (B) containing 3.8 g of potassium bromide with vigorous stirring over 45 seconds. The temperature of the reaction solution was kept at 45° C. for 4 minutes, then raised to 63° C. To this was added 24 g of lime-processed gelatin together with 185 ml of distilled water, then, 208 ml of an aqueous solution (C) containing 73 g of silver nitrate and a 24.8% aqueous solution (D) potassium bromide were added over 13 minutes with increasing addition flow rate and controlling the silver potential of the reaction solution to 0 mV based on the saturated calomel electrode. After completion of the addition, the temperature of the reaction solution was kept at 63° C. for 2 minutes, then, lowered to 45° C.

Then, 15 ml of 1 N sodium hydroxide was added. Two minutes later, 60 ml of an aqueous solution (E) containing 8.4 g of silver nitrate and 461 ml of an aqueous solution (F) containing 8.3 g of potassium iodide were added over 5 minutes. Further, 496 ml of an aqueous solution (G) containing 148.8 g of silver nitrate and a 25% aqueous solution (H) containing potassium bromide were added over 47 minutes while controlling the silver potential of the reaction solution to 90 mV based on the saturated calomel electrode. Thirty seconds after completion of the addition, an aqueous solution containing 2 g of potassium bromide and 0.06 g of sodium ethylthiosuofonate was added. The temperature of the solution was lowered, and desalting, dispersion and chemical sensitization were conducted in the same manner as in the blue photosensitive silver halide emulsion (2).

Regarding particles of the resultant emulsion, the proportion of plate-like particles occupied over 99% of the total projected area of the all particles. The average diameter in terms of a sphere was 0.44 μm. The average thickness was 0.2 μm, average equivalent circle diameter was 0.53 μm, and the average aspect ratio was 2.6 (hexagonal plate-like particle).

A method for preparing a green photosensitive silver halide emulsion (4) is described below.

1191 ml of distilled water containing 0.96 g of gelatin having an average molecular weight of 12000 and 0.9 g of potassium bromide was charged in a reaction vessel, and heated up to 40° C. To this solution were added 17.5 ml of an aqueous solution (A) containing 0.7 g of silver nitrate and 17.5 ml of an aqueous solution (B) containing 1.051 g of potassium bromide with vigorous stirring over 120 seconds. Thirty seconds after the completion of the addition, 12 ml of a 10% potassium bromide aqueous solution was added, and after 30 seconds, the temperature of the reaction solution was raised to 75° C. To this was added 35.0 g of lime-processed gelatin together with 250 ml of distilled water, then, 56 ml of an aqueous solution (C) containing 19.0 g of silver nitrate and 461 ml of an aqueous solution (D) containing 10 g of potassium bromide were added over 7 minutes and 35 seconds while increasing addition flow rate.

Then, 302 ml of an aqueous solution (E) containing 96.7 g of silver nitrate and an aqueous solution (F) containing potassium iodide in a mol ratio to potassium bromide of 3.3:96.7 (concentration of potassium bromide: 26%) were added over 20 minutes while increasing addition flow rate and controlling the silver potential of the reaction solution to 0 mV based on the saturated calomel electrode. Further, 97 ml of an aqueous solution (G) containing 24.1 g of silver nitrate and a 21.9% aqueous solution (H) of potassium bromide were added over 3 minutes while controlling the silver potential of the reaction solution to 0 mV based on the saturated calomel electrode. After completion of the addition, the temperature of the reaction solution was kept at 75° C. for 1 minute, then, lowered to 55° C. Then, 122 ml of an aqueous solution (I) containing 8.3 g of silver nitrate and 332 ml of an aqueous solution (J) containing 7.48 g of potassium iodide were added over 5 minutes. After completion of the addition, 7.11 g of potassium bromide was added, and the solution was kept at 55° C. for 1 minute. Then, 228 ml of an aqueous solution (K) containing 62.8 g of silver nitrate and 201 ml of an aqueous solution (L) containing 48.3 g of potassium bromide were added over 8 minutes. The temperature of the solution was lowered, and desalting and dispersion were conducted in the same manner as in the blue photosensitive silver halide emulsion (1). Chemical sensitization was also conducted in the same manner as in the blue photosensitive silver halide emulsion (1) except that a gelatin dispersed material of a mixture (molar ratio, 79:18:3) of the sensitizing dye (13), (14) and (15) was added instead of the sensitizing dye (12).

Regarding particles of the resultant emulsion, the proportion of plate-like particles occupied over 99% of the total projected area of all particles. The average diameter in terms of a sphere was 0.85 μm. The average thickness was 0.26 μm, average equivalent circle diameter was 1.25 μm, and the average aspect ratio was 4.8.

Sensitizing dye (13) for green photosensitive silver halide emulsion

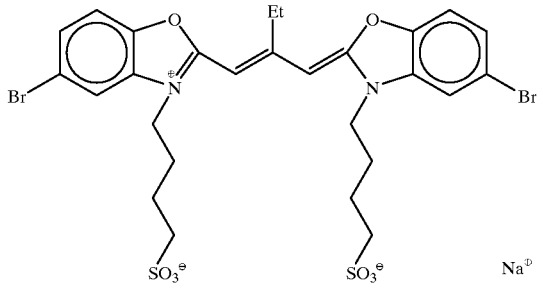

Sensitizing dye (14) for green photosensitive silver halide emulsion

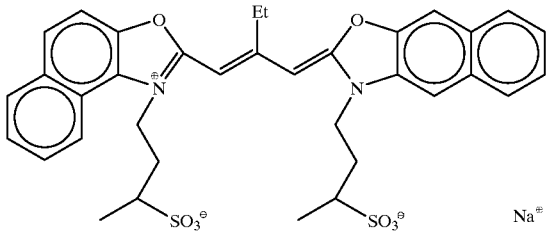

Sensitizing dye (15) for green photosensitive silver halide emulsion

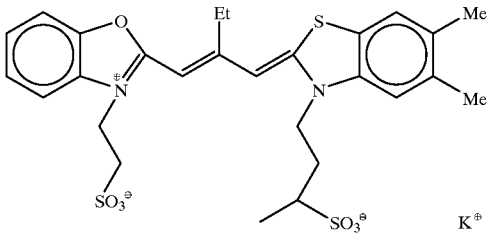

A method for preparing a green photosensitive silver halide emulsion (5) is described below.

Particle formation, desalting and dispersion were conducted in the same manner as in the blue photosensitive silver halide emulsion (3) except that sodium hydroxide and sodium ethylthiosulfonate were not added during particle formation, and chemical sensitization was conducted in the same manner as in the green photosensitive silver halide emulsion (4).

Regarding particles of the resultant emulsion, the proportion of plate-like particles occupied over 99% of the total projection area of all particles. The average diameter in terms of a sphere was 0.66 μm. The average thickness was 0.17 μm, average equivalent circle diameter was 1.05 μm, and the average aspect ratio was 6.3.

A method for preparing a green photosensitive silver halide emulsion (6) is described below.

Particle formation, desalting and dispersion were conducted in the same manner as in the blue photosensitive silver halide emulsion (3) except that the amount of sodium ethylthiosulfonate was changed to 4 mg and sodium hydroxide was not added during particle formation. Chemical sensitization was conducted in the same manner as in the green photosensitive silver halide emulsion (4) except that the selenium sensitizing agent was not added during the chemical sensitization.

Regarding particles of the resultant emulsion, the proportion of plate-like particles occupied over 99% of the total projection area of all particles. The average diameter in terms of a sphere was 0.44 μm. The average thickness was 0.2 μm, average equivalent circle diameter was 0.53 μm, and the average aspect ratio was 2.6 (hexagonal plate-like particle).

A method for preparing a red photosensitive silver halide emulsion (7) is described below.

Particle formation, desalting, dispersion and chemical sensitization were conducted in the same manner as in the green photosensitive silver halide emulsion (4) except that as the sensitizing pigment in the chemical sensitization, a gelatin dispersed material of a sensitizing dyes (16), and a gelatin dispersed material of a mixture of sensitizing dyes (17) and (18) (molar ratio, sensitizing dyes (16):sensitizing dyes (17):sensitizing dyes (18)=40:2:58) were added.

Regarding particles of the resultant emulsion, the proportion of plate-like particles occupied over 99% of the total projection area of all particles. The average diameter in terms of a sphere was 0.85 μm. The average thickness was 0.26 μm, average equivalent circle diameter was 1.25 μm, and the average aspect ratio was 4.8.

Sensitizing dye (16) for red photosensitive silver halide emulsion

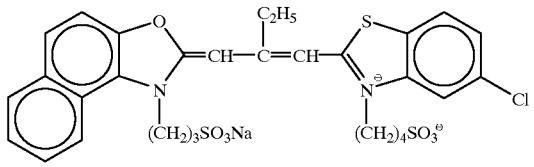

Sensitizing dye (17) for red photosensitive silver halide emulsion

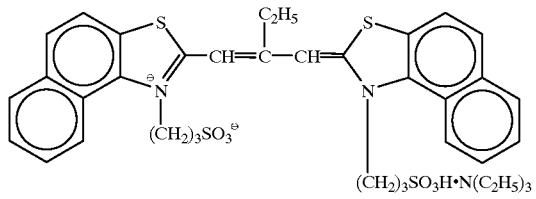

Sensitizing dye (18) for red photosensitive silver halide emulsion

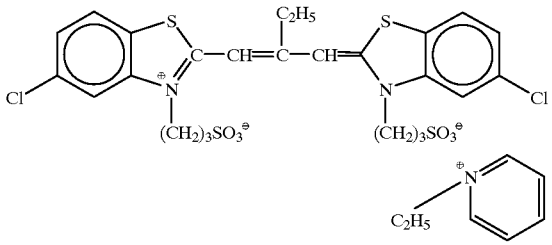

A method for preparing a red photosensitive silver halide emulsion (8) is described below.

Particle formation, desalting, dispersion and chemical sensitization were conducted in the same manner as in the green photosensitive silver halide emulsion (5) except that as the sensitizing pigment in the chemical sensitization, a gelatin dispersed material of a sensitizing dye (16), and a gelatin dispersed material of a mixture of sensitizing dye (17) and (18) (molar ratio, sensitizing dye (16):sensitizing dye (17):sensitizing dye (18)=40:2:58) were added.

Regarding particles of the resultant emulsion, the proportion of plate-like particles occupied over 99% of the total projection area of all particles. The average diameter in terms of a sphere was 0.66 μm. The average thickness was 0.17 μm, average equivalent circle diameter was 1.05 μm, and the average aspect ratio was 6.3.

A method for preparing a red photosensitive silver halide emulsion (9) is described below.

Particle formation, desalting, dispersion and chemical sensitization were conducted in the same manner as in the green photosensitive silver halide emulsion (6) except that as the sensitizing dye in the chemical sensitization, a gelatin dispersed material of a sensitizing pigment (16), and a gelatin dispersed material of a mixture of sensitizing dyes (17) and (18) (molar ratio, sensitizing pigments (16) :sensitizing pigment (17):sensitizing pigment (18)=40:2:58) were added.

Regarding particles of the resultant emulsion, the proportion of plate-like particles occupied over 99% of the total projection area of all particles. The average diameter in terms of a sphere was 0.44 μm. The average thickness was 0.2 μm, average equivalent circle diameter was 0.53 μm, and the average aspect ratio was 2.6 (hexagonal plate-like particle)

<Preparation method of zinc hydroxide dispersion>

31 g of zinc hydroxide powder having a particle size of primary particles of 0.2 μm, 1.6 g of carboxymethylcellulose as a dispersing agent and 0.4 g of poly sodium acrylate, 8.5 g of lime-processed osein gelatin and 158.5 ml of water were mixed, and the mixture was dispersed for 1 hour by a mill using glass beads. After the dispersion, the glass beads were filtered off, to obtain 188 g of a dispersed material of zinc hydroxide.

<Preparation method of emulsified dispersion of coloring developer and coupler>

Oil phase components and water phase components shown in Table 1 were respectively dissolved to obtain a uniform solution at 60° C. The oil phase components and the water phase components were combined, and the mixture was dispersed at 10000 rpm for 20 minutes by a dissolver equipped with a disperser having a diameter of 5 cm in a 1 liter stainless vessel. To this was added hot water in an amount shown in Table 1 as later added water, and the mixture was mixed at 2000 rpm for 10 minutes. Thus, an emulsified dispersion composed of cyan, magenta and yellow three color couplers and a coloring developer was prepared.

TABLE 1

| | | Cyan | Magenta | Yellow |
|---|---|---|---|---|
| Oil phase | Cyan dye forming coupler C-1 | 3.58 g | — | — |
| | Magenta dye forming coupler M-1 | — | 2.63 g | — |
| | Yellow dye forming coupler Y-1 | — | — | 3.01 g |
| | Coloring developer D-10 | 1.49 g | 2.25 g | — |
| | Coloring developer D-9 | 0.73 g | — | — |
| | Coloring developer D-34 | — | — | 2.42 g |
| | Tricresyl phosphate | 2.75 g | 2.5 g | 3.83 g |
| | Ethyl acetate | 6 ml | 6 ml | 6 ml |
| | Cyclohexane | 6 ml | 6 ml | 6 ml |
| Water phase | Lime-processed gelatin | 4 g | 4 g | 4 g |
| | Sodium tridecylbenzene-sulfonate | 0.27 g | 0.27 g | 0.27 g |
| | Water | 53 ml | 53 ml | 53 ml |
| | Later added water | 28 ml | 30 ml | 29 ml |

Cyan coupler C-1

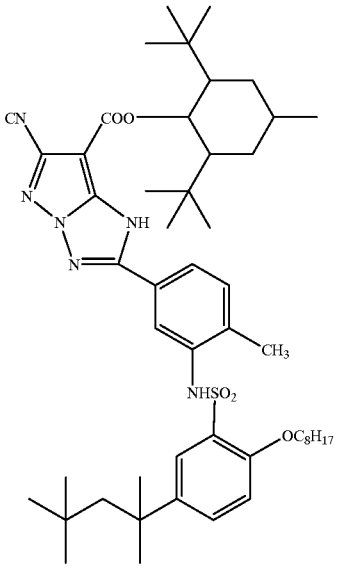

Magenta coupler M-1

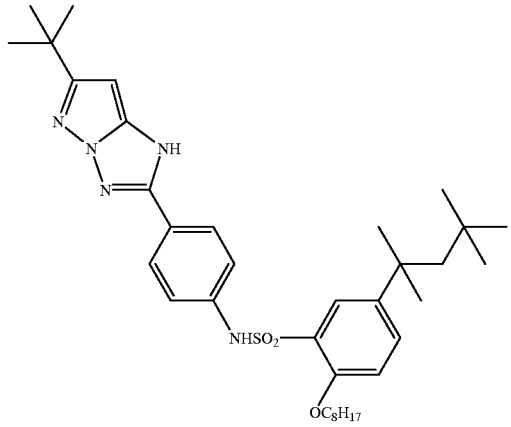

TABLE 1-continued

| | Cyan | Magenta | Yellow |
|---|---|---|---|
| Yellow coupler Y-1 | | | |

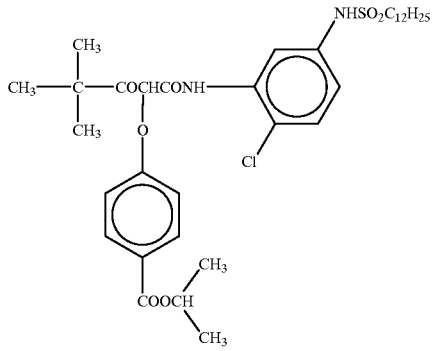

<Preparation of dye composition for yellow filter, magenta filter and anti-halation>

A dye composition was prepared as an emulsified dispersion and added as described below.

7.1 g of a yellow dye (YF-1) was dissolved in 6.6 g of tricresyl phosphate, 30 cc of ethyl acetate and 30 cc of cyclohexanone, and the resultant solution was added to 135 g of a 7.8% gelatin aqueous solution containing 0.75 g of sodium dodecylbenzenesulfonate, and the mixture was stirred at 10000 rpm for 20 minutes using a dissolver stirrer, for emulsifying dispersion. After the dispersion, distilled water was added so that the total weight reached 260 g, and the mixture was mixed for 10 minutes at 2000 rpm, to prepare a dye dispersion for a yellow filter.

The dye was changed to 6.1 g of a magenta dye (MF-1), and a dye dispersion for a magenta filter was prepared in the same manner as described above.

The dye was changed to 8.9 g of a cyan dye (CF-1), and a dye dispersion for an anti-halation layer was prepared in the same manner as described above.

YF-1

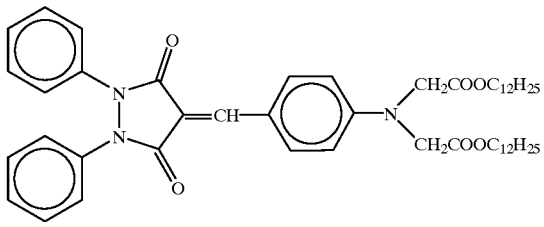

MF-1

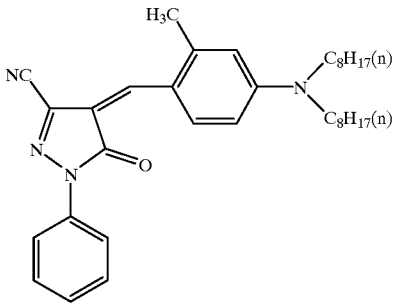

CF-1

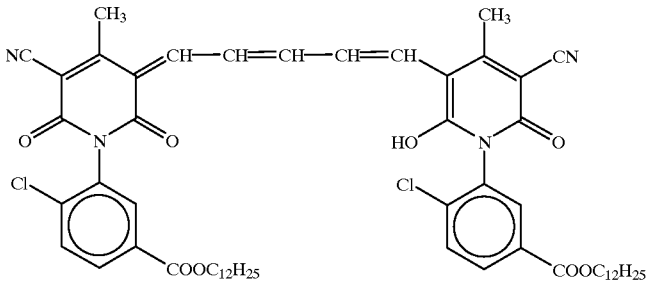

<Production of substrate>

Then, a support to be used in the present invention was produced according to the method described below.

100 parts by weight of polyethylene-2,6-naphthalate (PEN) polymer and 2 parts by weight of Tinuvin P. 326 (manufactured by Ciba Geigy) as an ultraviolet absorber were dried, then, melted at 300° C., and extruded through a T die. The resultant mixture was subjected to longitudinal drawing of 3.3 times at 140° C., and subsequently to transverse drawing of 3.3 times at 130° C., and further, was thermally fixed at 250° C. for 6 seconds to obtain a PEN film having a thickness of 92 μm. A blue dye, magenta dye and yellow dye were (Journal of Technical Disclosure: No. 94-6023, I-1, I-4, I-6, I-24, I-26, I-27, II-5) added to this PEN film so that the yellow concentration was 0.01, the magenta concentration was 0.08 and the cyan concentration was 0.09. Further, the film was wound around a stainless core having a diameter of 20 cm, and given a heat history of 30 hours at 113° C., to obtain a support which does not tend to curl.

<Application and formation of primer layer>

Corona discharge treatment, UV irradiation treatment and glow discharge treatment were performed on both sides of the above-described substrate. Then, a primer solution composed of gelatin (0.1 g/m$^2$), sodium α-sulfodi-2-ethylhexyl succinate (0.01 g/m$^2$), salicylic acid (0.025 g/m$^2$), PQ-1 (0.005 g/m$^2$) and PQ-2 (0.006 g/m$^2$) was applied (10 cc/m$^2$, bar coater used) to form a primer layer to the side on which a photosensitive layer would be provided. Drying was conducted at 115° C. for 6 minutes (all temperatures of rollers and transferring apparatuses in drying zone were 115° C.).

<Application and formation of back layer>

1) Application of antistatic layer

A dispersion of a fine particle powder having a specific resistance of 5 Ω.cm composed of a tin oxide-antimony oxide complex having an average particle size of 0.005 μm (particle size of secondary flocculated particle: about 0.08 μm; 0.0277 g/m$^2$) gelatin (0.03 g/m$^2$), $(CH_2{=}CHSO_2CH_2CH_2NHCO)_2CH_2$ (0.02 g/m$^2$), poly (polymerization degree: 10) oxyethylene-p-nonylphenol (0.005 g/m$^2$), PQ-3 (0.008 g/m$^2$) and resorcin were applied.

2) Application of magnetic recording layer 0.06 g/m$^2$ of cobalt-γ-iron oxide (specific surface area: 43 m$^2$/g, long axis 0.14 μm, short axis 0.03 μm, saturated magnetization 89 emu/g, $Fe^{+2}/Fe^{+3}$=6/94, surface treated with aluminum oxide silicon oxide of 2% by weight of iron oxide) which had been coated with 3-poly (polymerization degree: 15) oxyethylene-propyloxytrimethoxysilane (15% by weight) was applied by a bar coater using 1.15 g/m$^2$ of diacetylcellulose (dispersion of iron oxide was conducted by open kneader and sand mill), PQ-4 (0.075 g/m$^2$) and PQ-5 (0.004 g/m$^2$) as a curing agent, acetone, methyl ethyl ketone, cyclohexanone and dibutyl phthalate as a solvent, to obtain a magnetic recording layer having a thickness of 1.2 μm. $C_6H_{13}CH(OH)C_{10}H_{20}COOC_{40}H_{81}$ (50 g/m$^2$) as a lubricant, and, a silica particle (average particle size 1.0 μm) as a matting agent and aluminum oxide (manufactured by Reynolds Metal Corp.: ERC-DBM; average particle size 0.44 μm) as an abrasive (respectively, 5 mg/m$^2$ and 15 mg/m$^2$) were added. The mixture was dried at 115° C. for 6 minutes (all temperatures of rollers and transferring apparatuses in drying zone were 115° C.). Increase in color concentration of DB of the magnetic recording layer by X-light (blue filter) was about 0.1, and the magnetic recording layer had a saturated magnetizing moment of 4.2 emu/g, a magnetic retention of 7.3×10$^4$ A/m and an angular form content of 65%.

3) Preparation of sliding layer

Hydroxyethylcellulose (25 mg/m$^2$), PQ-6 (7.5 mg/m$^2$), PQ-7 (1.5 mg/m$^2$) and polydimethylsiloxane 1.5 mg/m$^2$ were applied. This mixture was melted at 105° C. in xylene/propylene glycol monomethyl ether (1/1), poured and dispersed into propylene monomethyl ether (10-fold amount) at normal temperature, then made into a dispersion (average particle size 0.01 μm) in acetone before being used for addition. The mixture was dried at 115° C. for 6 minutes (all temperatures of rollers and transferring apparatuses in drying zone were 115° C.). The sliding layer exhibited excellent properties: a kinetic friction coefficient 0.10 (5 mm ϕ stainless hard sphere, load 100 g, speed 6 cm/minute) and a static friction coefficient 0.09 (crip method), and a kinetic friction coefficient between the emulsion surface and the sliding layer of 0.18.

A photosensitive element 101 having a multi-layered structure shown in Table 2 was produced using the above described materials and support (base).

PQ-1

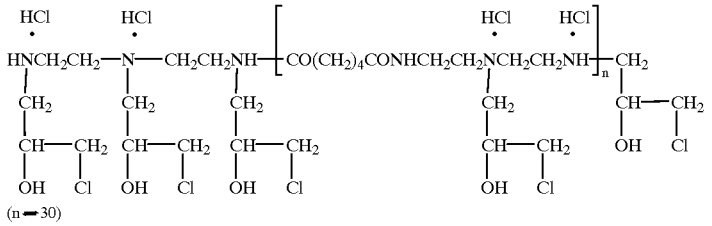

(n = 30)

PQ-2

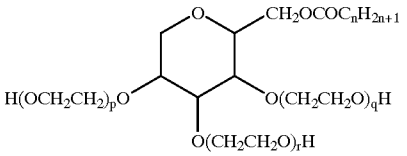

(N = 17)
(p + q + r = 20)

-continued

PQ-3

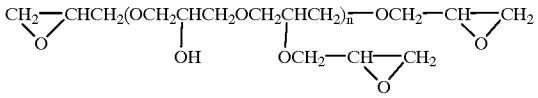

(n 3)

PQ-4

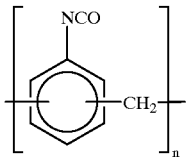

(n 2 ~ 5)

PQ-5

$(CH_3O)_3SiCH_2CH_2CH_2O(CH_2CH_2O)_nCH_3$
(n 7.3)

PQ-6

$C_{50}H_{101}(CH_2CH_2O)_nH$
(n 16)

PQ-7

$C_5F_{17}SO_2N(C_3H_7)(CH_2CH_2O)_n(CH_2)_4SO_3Na$
(n 4)

TABLE 2

Photosensitive element 101

| Layer constitution | Main component | Amount applied ($g/m^2$) |
|---|---|---|
| 13th layer | Gelatin | 0.89 |
| Protective layer | Matting agent (silica) | 0.02 |
| 12th layer | Gelatin | 0.76 |
| Intermediate layer | Zinc hydroxide | 0.34 |
| 11th layer | Gelatin | 0.86 |
| Yellow color forming layer | Blue photosensitive silver halide emulsion (1) | 0.50 (Amount of silver) |
| (High sensitive layer) | Yellow dye forming coupler (Y-1) | 0.29 |
| | Coloring developer (D-34) | 0.23 |
| | Tricresyl phosphate | 0.36 |
| 10th layer | Gelatin | 1.44 |
| Yellow color forming layer | Blue photosensitive silver halide emulsion (2) | 0.25 (Amount of silver) |
| (Low sensitive layer) | Blue photosensitive silver halide emulsion (3) | 0.25 (Amount of silver) |
| | Yellow dye forming coupler (Y-1) | 0.45 |
| | Coloring developer (D-34) | 0.36 |
| | Tricresyl phosphate | 0.56 |
| 9th layer | Gelatin | 0.21 |
| Intermediate layer | Yellow dye YF-1 | 0.14 |
| Yellow filter layer | Tricresyl phosphate | 0.13 |
| 8th layer | Gelatin | 0.43 |
| Magenta color forming layer | Green photosensitive silver halide emulsion (4) | 0.55 (Amount of silver) |
| (High sensitive layer) | Magenta dye forming coupler (M-1) | 0.04 |
| | Coloring developer (D-10) | 0.03 |
| | Tricresyl phosphate | 0.04 |
| 7th layer | Gelatin | 0.5 |
| Magenta color forming layer | Green photosensitive silver halide emulsion (5) | 0.35 (Amount of silver) |
| (Intermediate layer) | Magenta dye forming coupler (M-1) | 0.07 |
| | Coloring developer (D-10) | 0.06 |
| | Tricresyl phosphate | 0.07 |
| 6th layer | Gelatin | 0.52 |
| Magenta color forming | Green photosensitive silver | 0.34 (Amount of |

TABLE 2-continued

Photosensitive element 101

| Layer constitution | Main component | Amount applied ($g/m^2$) |
|---|---|---|
| layer | halide emulsion (6) | silver) |
| (Low sensitive layer) | Magenta dye forming coupler (M-1) | 0.19 |
| | Coloring developer (D-10) | 0.16 |
| | Tricresyl phosphate | 0.18 |
| 5th layer | Gelatin | 1.15 |
| Intermediate layer | Magenta dye MF-1 | 0.1 |
| Magenta filter layer | Zinc hydroxide | 2.03 |
| | Tricresyl phosphate | 0.1 |
| 4th layer | Gelatin | 0.96 |
| Cyan color forming layer | Red photosensitive silver halide emulsion (7) | 1.05 (Amount of silver) |
| (High sensitive layer) | Cyan dye forming coupler (C-1) | 0.07 |
| | Coloring developer (D-10) | 0.03 |
| | Coloring developer (D-9) | 0.014 |
| | Tricresyl phosphate | 0.05 |
| 3rd layer | Gelatin | 0.24 |
| Cyan color forming layer | Red photosensitive silver halide emulsion (8) | 0.27 (Amount of silver) |
| (Intermediate layer) | Cyan dye forming coupler (C-1) | 0.054 |
| | Coloring developer (D-10) | 0.022 |
| | Coloring developer (D-9) | 0.011 |
| | Tricresyl phosphate | 0.04 |
| 2nd layer | Gelatin | 0.73 |
| Cyan color forming layer | Red photosensitive silver halide emulsion (9) | 0.55 (Amount of silver) |
| (Low sensitive layer) | Cyan dye forming coupler (C-1) | 0.32 |
| | Coloring developer (D-10) | 0.13 |
| | Coloring developer (D-9) | 0.065 |
| | Tricresyl phosphate | 0.25 |
| 1st layer | Gelatin | 0.24 |
| Antihalation layer | Cyan dye CF-1 | 0.2 |
| | Tricresyl phosphate | 0.15 |

TABLE 2-continued

| Photosensitive element 101 | | |
|---|---|---|
| Layer constitution | Main component | Amount applied ($g/m^2$) |
| Primer layer | | |
| | PEN support of 92 μm thick | |
| | Primer layer | |
| | Antistatic layer | |
| | Magnetic recording layer | |
| | Sliding layer | |

Note: the applied layer on the photosensitive layer side is cured by 0.1 $g/m^2$ of a film curing agent (H-1) H-1 $CH_2{=}CH{-}SO_2{-}CH_2{-}SO_2{-}CH{=}CH_2$ Further, a first treating element R-1 shown in Table 3, and a second treating element R-2 shown in Table 4 were produced.

TABLE 3

| First treating element R-1 | | |
|---|---|---|
| Constituent layer | Main component added | Amount added ($g/m^2$) |
| 4th layer | Gelatin | 0.22 |
| | κ-carageenan | 0.06 |
| | Silicon oil | 0.02 |
| | Matting agent (PMMA) | 0.4 |
| 3rd layer | Gelatin | 0.24 |
| | Hardener (H-2) | 0.18 |
| 2nd layer | Gelatin | 2.41 |
| | Dextran | 1.31 |
| | Mordant (P-1) | 2.44 |
| | Guanidine picolinate | 5.82 |
| | Potassium quinolinate | 0.45 |
| | Sodium quinolinate | 0.36 |
| 1st layer | Gelatin | 0.19 |
| | Hardener (H-2) | 0.18 |
| | Primer layer | |
| | 63 μm thick PET support | |

H-2

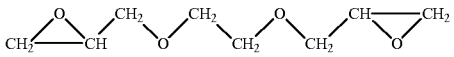

P-1

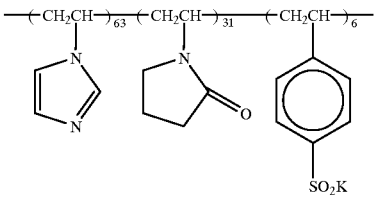

TABLE 4

| Second treating element R-2 | | |
|---|---|---|
| Constituent layer | Main component added | Amount added ($g/m^2$) |
| 4th layer | Gelatin | 0.49 |
| | Matting agent (silica) | 0.01 |
| 3rd layer | Gelatin | 0.24 |
| | Hardener (H-3) | 0.25 |
| 2nd layer | Gelatin | 4.89 |
| | Polyacrylic acid (20% neutralized substance) | 2.31 |
| | Solvent for silver halide | 5.77 |

TABLE 4-continued

| Second treating element R-2 | | |
|---|---|---|
| Constituent layer | Main component added | Amount added ($g/m^2$) |
| 1st layer | Gelatin | 0.37 |
| | Hardener (H-3) | 0.58 |
| | Gelatin primer layer | |
| | 63 μm thick PET support | |

H-3

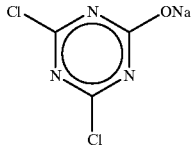

Solvent for silver halide

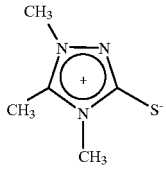

The photosensitive element 101 produced was cut into APS format, perforated, and filled in acartridge and installed into an APS camera, and a person and Macbeth chart were photographed.

15 $cc/m^2$ (corresponding to 45% of the maximum swelling) of water having a temperature of 40° C. was imparted to this photographed photosensitive element, then, the element was laminated with the first treating element R-1, and the resultant laminate was heated at 83° C. using a heat drum from the back side of the photosensitive element for 17 seconds. The first treating element R-1 was separated from the photosensitive element 101, and 15 $cc/m^2$ of water having a temperature of 40° C. was imparted to this photosensitive element again, then the element was laminated with the second treating element R-2, and the resulted laminate was heated at 83° C. for 10 seconds. The second treating element R-2 was separated from the photosensitive element 101, to obtain a negative image having excellent transparency on the photosensitive element. This image was read by a digital image reading apparatus Frontier SP-1000 (manufactured by Fuji Photo Film Co., Ltd.), the image was treated on a work station and output on a heat developing printer (PICTOGRAPHY 4000, manufactured by Fuji Photo Film Co., Ltd.) to obtain an excellent print image.

The used negative was again wound into the cartridge, this sample was left for one week under conditions of 60° C. and 70%, and the image was read again by SP-1000, the image was treated and output to obtain an excellent print image in a like manner.

Example 2

A photosensitive element 102 was produced in the same manner as in the photosensitive element 101 except that tricresyl phosphate was changed to trioctylamine which was the compound represented by the general formula (6) in the formulation of the emulsion in Table 1.

The photosensitive element 102, the first treating element R-1 and the second treating element R-2 were used, and evaluation was conducted in the same manner as in Example 1. As a result of acceleration particularly of magenta color developing, the print image which had been obtained by reading this negative and conducting output was further excellent. Also, storage stability of the negative was the same as that of the photosensitive element 101.

Comparative Example 1

A second treating element R-3 was produced in the same manner as described above except that polyacrylic acid was removed from the second treating member R-2.

The photosensitive element 101, 102, the first treating element R-1 and the second treating element R-3 were used, and evaluation was conducted in the same manner as in Example 1 to find an excellent print image obtained. However, when the negative was left for one week under conditions of 60° C. and 70%, color development occurred also in non-image part, and discrimination of the image was lost, and even if this was read by SP-1000, no excellent print image could be obtained.

As described above, according to the present invention, a novel image formation method by which an excellent image having excellent storage stability can be obtained by simple treatment can be provided.

What is claimed is:

1. An image formation method in which a photosensitive element comprising a support carrying thereon a photosensitive layer comprising at least silver halide particles, coloring developer, coupler and binder is exposed in image-wise fashion, then, a first treating element comprising a support carrying thereon a treating layer comprising at least a base and/or base precursor is laminated on said photosensitive element so that the treating layer of the first treating element faces the photosensitive layer of the photosensitive element and the resultant laminate is heated for 5 to 60 seconds at a temperature of 60 to 100° C. in the presence of water in an amount of 1 cc/m$^2$ to 50 cc/m$^2$ between the photosensitive layer of the photosensitive element and the treating layer of the first treating element, then, the photosensitive element is separated from the first treating element, then, a second treating element comprising a support carrying thereon a solvent for silver halide and a treating layer comprising at least an acidic polymer is laminated on said photosensitive element so that the treating layer of the second treating element faces the photosensitive layer of the photosensitive element and the resultant laminate is heated for 2 to 60 seconds at a temperature of 40 to 100° C. in the presence of water in an amount of 1 cc/m$^2$ to 50 cc/m$^2$ between the photosensitive layer of the photosensitive element and the treating layer of the second treating element, then, the photosensitive element is separated from the second treating element, to form an image on the photosensitive element.

2. An image formation method according to claim 1, wherein the coloring developer is at least one compound selected from compounds represented by the following general formulae (1) to (5):

General formula (1)

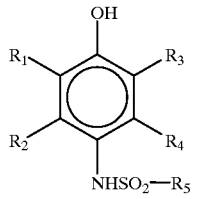

-continued

General formula (2)

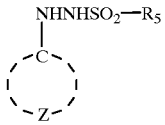

General formula (3)

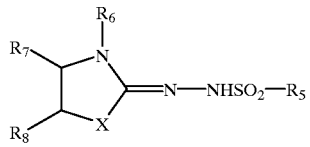

General formula (4)

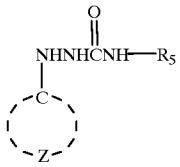

General formula (5)

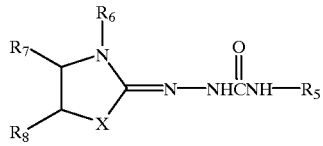

wherein, $R_1$ to $R_4$ represent each independently a hydrogen atom, halogen atom, alkyl group, aryl group, alkylcarbonamide group, arylcarbonamide group, alkylsulfoneamide group, arylsulfoneamide group, alkoxy group, aryloxy group, alkylthio group, arylthio group, alkylcarbamoyl group, arylcarbamoyl group, carbamoyl group, alkylsulfamoyl group, arylsulfamoyl group, sulfamoyl group, cyano group, alkylsulfonyl group, arylsulfonyl group, alkoxycarbonyl group, aryloxy carbonyl group, alkylcarbonyl group, arylcarbonyl group or acyloxy group, and $R_5$ represents an alkyl group, aryl group or heterocyclic groups; Z represents an atom group forming an aromatic ring or a heterocyclic ring and when Z represents a benzene ring, the total value of Hammett constants (σ) of the substituents thereof is 1 or more; $R_6$ represents an alkyl group; X represents an oxygen atom, sulfur atom, selenium atom or alkyl-substituted or aryl-substituted tertiary nitrogen atom; $R_7$ and $R_8$ represent a hydrogen atom or substituent, and $R_7$ and $R_8$ may bond each other to form a double bond or ring.

3. An image formation method according to claim 1, wherein the photosensitive element contains a compound represented by the general formula (6):

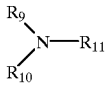

wherein, $R_9$ and $R_{10}$ represent each independently a hydrogen atom, aliphatic group or aryl group, and $R_{11}$ represents an aliphatic group or the general formula (Ab) having the structure described below:

General formula (Ab)

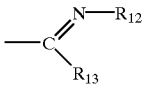

wherein, $R_{12}$ represents a hydrogen atom, aliphatic group or aryl group, and $R_{13}$ represents an aliphatic group, aryl group or amino group; $R_9$ and $R_{10}$, $R_9$ and $R_{11}$, $R_{10}$ and $R_{11}$, and $R_{12}$ and $R_{13}$ may bond each other to form a 5 to 7-membered ring; three groups $R_9$, $R_{10}$ and $R_{11}$ may bond each other to form a bicyclo ring; the total number of carbon atoms in $R_9$, $R_{10}$ and $R_{11}$ is 10 or more, and at least one of $R_9$ and $R_{10}$ is an aliphatic group; when another one of $R_9$ and $R_{10}$ is an aryl group, $R_{11}$ is a group represented by the general formula (Ab).

4. An image formation method according to claim 2, wherein the photosensitive member contains a compound represented by the general formula (6):

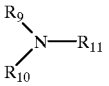

wherein $R_9$ and $R_{10}$ represent each independently a hydrogen atom, aliphatic group or aryl group, and $R_{11}$ represents an aliphatic group or the general formula (Ab) having the structure described below:

General formula (Ab)

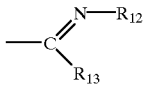

wherein $R_{12}$ represents a hydrogen atom, aliphatic group or aryl group, and $R_{13}$ represents an aliphatic group, aryl group or amino group; $R_9$ and $R_{10}$, $R_9$ and $R_{11}$, $R_{10}$ and $R_{11}$, and $R_{12}$ and $R_{13}$ may bond each other to form a 5 to 7-membered ring; three groups $R_9$, $R_{10}$ and $R_{11}$ may bond each other to form a bicyclo ring; the total number of carbon atoms in $R_9$, $R_{10}$ and $R_{11}$ is 10 or more, and at least one of $R_9$ and $R_{10}$ is an aliphatic group; when another one of $R_9$ and $R_{10}$ is an aryl group, $R_{11}$ is a group represented by the general formula (Ab).

5. An image formation method in which after formation of an image on the photosensitive element by the method of claim 1, a color image is further formed on other recording material according to this image information.

6. An image formation method in which after formation of an image on the photosensitive element by the method of claim 1, the image is read as digital information, a color image is further formed on other recording material according to this digital image information.

7. An image formation method according to claim 1, wherein the acidic polymer is present in the second treating element in an amount of at least 2.31 $g/m^2$.

* * * * *